US007822500B2

(12) United States Patent
Kobayashi et al.

(10) Patent No.: US 7,822,500 B2
(45) Date of Patent: Oct. 26, 2010

(54) POLISHING APPARATUS AND POLISHING METHOD

(75) Inventors: Yoichi Kobayashi, Tokyo (JP); Yasumasa Hiroo, Tokyo (JP); Tsuyoshi Ohashi, Tokyo (JP)

(73) Assignee: Ebara Corporation, Tokyo (JP)

( * ) Notice: Subject to any disclaimer, the term of this patent is extended or adjusted under 35 U.S.C. 154(b) by 213 days.

(21) Appl. No.: 11/596,726

(22) PCT Filed: Jun. 20, 2005

(86) PCT No.: PCT/JP2005/011676

§ 371 (c)(1),
(2), (4) Date: Nov. 16, 2006

(87) PCT Pub. No.: WO2005/123335

PCT Pub. Date: Dec. 29, 2005

(65) Prior Publication Data

US 2007/0243795 A1 Oct. 18, 2007

(30) Foreign Application Priority Data

Jun. 21, 2004 (JP) ..... 2004-183063

(51) Int. Cl.
*G05B 13/02* (2006.01)
*G06F 19/00* (2006.01)
*B24B 49/00* (2006.01)
*B24B 51/00* (2006.01)

(52) U.S. Cl. ..... 700/108; 700/28; 451/5

(58) Field of Classification Search ..... 700/28, 700/32, 33, 44, 45, 108–110, 117–121, 164; 438/14–18, 689–693; 451/1, 5, 11
See application file for complete search history.

(56) References Cited

U.S. PATENT DOCUMENTS 6,190,234 B1 * 2/2001 Swedek et al. ..... 451/6
6,276,989 B1 * 8/2001 Campbell et al. ..... 451/10
6,468,131 B1 * 10/2002 Korovin ..... 451/5
6,477,447 B1 * 11/2002 Lin ..... 700/301
6,492,273 B1 * 12/2002 Hofmann et al. ..... 438/692
6,562,185 B2 * 5/2003 Avanzino et al. ..... 156/345.13
6,594,542 B1 * 7/2003 Williams ..... 700/164
6,648,729 B2 * 11/2003 Lai et al. ..... 451/5
6,706,541 B1 3/2004 Toprac et al.
6,776,692 B1 8/2004 Zuniga et al.
6,914,000 B2 * 7/2005 Kamada ..... 438/692
6,935,922 B2 * 8/2005 Lehman et al. ..... 451/5

(Continued)

FOREIGN PATENT DOCUMENTS

EP 1 116 552 A2 7/2001
JP 2003-512519 4/2003

*Primary Examiner*—M. N. Von Buhr
(74) *Attorney, Agent, or Firm*—Wenderoth, Lind & Ponack, L.L.P.

(57) ABSTRACT

A polishing apparatus has a polishing table (18) having a polishing surface (40) and a top ring (20) for pressing a substrate against the polishing surface (40) while independently controlling pressing forces applied to a plurality of areas (C1-C4) on the substrate. The polishing apparatus has a sensor (52) for monitoring substrate conditions of a plurality of measurement points on the substrate, a monitor unit (53) for performing a predetermined arithmetic process on a signal from the sensor (52) to generate a monitor signal, and a controller (54) for comparing the monitor signal of the measurement points with the reference signal and controlling the pressing forces of the top ring (20) so that the monitor signal of the measurement point converges on the reference signal.

27 Claims, 27 Drawing Sheets

U.S. PATENT DOCUMENTS 6,991,516 B1 * 1/2006 David et al. ..... 451/5
7,024,268 B1 * 4/2006 Bennett et al. ..... 700/121
7,030,018 B2 * 4/2006 Lehman et al. ..... 438/692
7,074,109 B1 * 7/2006 Bennett et al. ..... 451/5
7,223,690 B2 * 5/2007 Kondo et al. ..... 438/637
7,247,080 B1 * 7/2007 Bennett et al. ..... 451/5
7,332,438 B2 * 2/2008 Lehman et al. ..... 438/692
7,455,785 B2 * 11/2008 Koike et al. ..... 216/12
2001/0008827 A1 7/2001 Kimura et al.
2001/0036676 A1 * 11/2001 Mitsuhashi et al. ..... 438/8
2002/0001862 A1 * 1/2002 Ushio et al. ..... 438/14
2002/0016066 A1 * 2/2002 Birang et al. ..... 438/689
2002/0055192 A1 5/2002 Redeker et al.
2003/0171071 A1 9/2003 Kimura et al.
2003/0176081 A1 9/2003 Redeker et al.
2003/0178587 A1 * 9/2003 Kim et al. ..... 250/559.27
2003/0205664 A1 * 11/2003 Abe et al. ..... 250/214 R
2004/0059456 A1 3/2004 Bode et al.
2004/0224613 A1 11/2004 Kimura et al.
2004/0242121 A1 12/2004 Hirokawa et al.
2005/0142991 A1 * 6/2005 Nakao et al. ..... 451/64
2005/0181706 A1 * 8/2005 Berman et al. ..... 451/5
2005/0239371 A1 * 10/2005 Togawa ..... 451/5
2007/0243794 A1 * 10/2007 Mundt ..... 451/5

* cited by examiner

| | D 2 | S | S | B | B |
|---|---|---|---|---|---|
| D 3 | u 3 \ D 4 | S | B | S | B |
| S | S | P B | P S | P S | P S |
| S | B | P S | Z R | Z R | N S |
| B | S | P S | Z R | Z R | N S |
| B | B | N S | N S | N S | N B |

FIG. 25

| | | D2 | S | S | B | B |
|---|---|---|---|---|---|---|
| Tp | D3 | D4 / u3 | S | B | S | B |
| S | S | S | PB | PB | PB | PB |
| S | S | B | PB | PS | PS | ZR |
| S | B | S | PB | PS | PS | ZR |
| S | B | B | ZR | ZR | ZR | NS |
| B | S | S | PS | ZR | ZR | ZR |
| B | S | B | ZR | NS | NS | NB |
| B | B | S | ZR | NS | NS | NB |
| B | B | B | NB | NB | NB | NB |

POLISHING APPARATUS AND POLISHING METHOD

TECHNICAL FIELD

The present invention relates to a substrate processing method, and more particularly to a polishing apparatus and a polishing method for polishing and planarizing a substrate such as a semiconductor wafer.

BACKGROUND ART

Some polishing apparatuses for polishing and planarizing a substrate such as a semiconductor wafer are capable of adjusting a pressure of a chamber in a carrier head. Such a polishing apparatus measures a physical quantity relating to a film thickness of a substrate and calculates a film thickness profile based on the physical quantity. Then, the polishing apparatus adjusts a pressure of a chamber in a carrier head based on a comparison between the calculated film thickness profile and a desired film thickness profile.

However, a conventional polishing apparatus does not perform a real-time control in which a pressure of a chamber in a carrier head is continuously adjusted during polishing. As a matter of course, a real-time control is expected to obtain polishing results that are closer to a desired thickness profile. When a real-time control is to be applied to a pressure adjusting method in a conventional polishing apparatus, a film thickness on a surface of a wafer or data that are substantially in proportion to the film thickness are required to be measured in situ. Accordingly, a real-time control is considerably limited in application depending upon types of films on a wafer or measurement methods.

Further, if a desired thickness profile is changed from moment to moment, complicated processes are required. If a desired thickness profile is fixed to a polished profile, manipulated variables become excessive or unstable particularly in a case where an initial film thickness is largely different from the desired thickness profile.

DISCLOSURE OF INVENTION

The present invention has been made in view of the above drawbacks. It is, therefore, a first object of the present invention to provide a practical polishing apparatus and method which can accurately control a polishing profile, a polishing time, or a polishing rate of a substrate.

Further, a second object of the present invention is to provide a practical substrate processing method which can accurately control a profile, a process time, or a process rate of a film formed on a substrate.

According to a first aspect of the present invention, there is provided a polishing apparatus having a polishing table having a polishing surface and a top ring for pressing a substrate against the polishing surface while controlling a pressing force applied to at least one area on the substrate. The polishing apparatus has a sensor for monitoring a substrate condition of at least one measurement point on the substrate, a monitor unit for performing a predetermined arithmetic process on a signal from the sensor to generate a monitor signal, and a storage device for storing a reference signal representing a relationship between a reference value for the monitor signal and time. The polishing apparatus includes a controller for comparing the monitor signal of the measurement point with the reference signal and controlling the pressing force of the top ring so that the monitor signal of the measurement point converges on the reference signal.

The top ring may be configured to independently control pressing forces applied to a plurality of areas on the substrate. The sensor may be operable to monitor substrate conditions of a plurality of measurement points on the substrate. The top ring may comprise a plurality of pressure chambers for independently applying pressing forces to the plurality of areas on the substrate.

The controller may be operable to calculate an averaged value of monitor signals of the plurality of measurement points at the beginning of polishing, and translate the reference signal in parallel with respect to a time series so that a reference signal at the beginning of polishing is equal to the averaged value.

The controller may be operable to calculate an averaged value of monitor signals of the plurality of measurement points at a desired time point of a polishing process, and translate the reference signal after the desired time point in parallel with respect to a time series so that a reference signal at the desired time point is equal to the averaged value.

The controller may be operable to translate the reference signal in parallel with respect to a time series so that a reference signal at the beginning of polishing is equal to a monitor signal of a predetermined measurement point on the substrate at the beginning of polishing.

The controller may be operable to translate the reference signal after a desired time point of a polishing process in parallel with respect to a time series so that a reference signal at the desired time point is equal to a monitor signal of a predetermined measurement point on the substrate at the desired time point.

The controller may be operable to translate the reference signal in parallel with respect to a time series at the beginning of polishing so that a polishing time becomes a desired period of time.

The controller may be operable to calculate a time point of the reference signal which is equal to the monitor signal, at a desired time point of a polishing process, and calculate a period of time from the time point at which the reference signal is equal to the monitor signal to a reference time point at which the reference signal becomes a predetermined value.

The reference signal may be a signal in which at least one of a type of film formed on the substrate, a laminated structure, an interconnection structure, a physical property of a polishing liquid, a temperature of the polishing surface, a temperature of the substrate, a thickness of a polishing tool forming the polishing surface is set as a parameter.

Further, a monitor signal obtained during a past polishing process using a polishing surface used in a present polishing process, or a monitor signal obtained at an initial stage of a past polishing process using another polishing surface already replaced may be used as the reference signal.

The controller may be operable to control the pressing force of the top ring by using a predictive control. In this case, a control period of the controller may be in a range of from 1 second to 10 seconds.

The monitor unit may be operable to exclude a monitor signal of a measurement point at a peripheral edge portion of the substrate. Alternatively, the monitor unit may be operable to correct a monitor signal of a measurement point at a peripheral edge portion of the substrate.

The sensor may comprise at least one of an eddy-current sensor, an optical sensor, and a microwave sensor. It is desirable that the sensor is operable to measure a film thickness on a surface of the substrate.

The polishing apparatus may further comprise an actuator for providing a relative movement between the polishing table and the top ring. In this case, the sensor may be disposed within the polishing table. The actuator may comprise a motor for rotating the polishing table.

The controller may be operable to interrupt the control intermittently during a polishing process. The controller may be operable to finish the control before a polishing endpoint and hold a polishing condition at that time until the polishing endpoint. The controller may be operable to employ a polishing condition at a time point at which a polishing process of one substrate is finished as an initial polishing condition for a polishing process of another substrate. The controller may be operable to detect a polishing endpoint based on a signal of the monitor unit.

According to a second aspect of the present invention, there is provided a polishing apparatus having a polishing table having a polishing surface and a top ring for pressing a substrate against the polishing surface while independently controlling pressing forces applied to a plurality of areas on the substrate. The polishing apparatus has a sensor for monitoring substrate conditions of a plurality of measurement points on the substrate, a monitor unit for performing a predetermined arithmetic process on a signal from the sensor to generate a monitor signal, and a controller for controlling the pressing forces of the top ring based on the monitor signal. The controller is operable to scale the pressing forces applied to the plurality of areas or variations of the pressing forces so that the pressing forces applied to all the areas are within a predetermined range when a pressing force applied to at least one of the plurality of areas exceeds the predetermined range.

According to a third aspect of the present invention, there is provided a polishing apparatus having a polishing table having a polishing surface and a top ring for pressing a substrate against the polishing surface while independently controlling pressing forces applied to a plurality of areas on the substrate. The polishing apparatus has a sensor for monitoring substrate conditions of a plurality of measurement points on the substrate, a monitor unit for performing a predetermined arithmetic process on a signal from the sensor to generate a monitor signal, and a controller for controlling the pressing forces of the top ring based on a time point when the monitor signal has an extreme. In this case, a non-metal film may be formed on a surface of the substrate.

According to a fourth aspect of the present invention, there is provided a polishing apparatus having a polishing table having a polishing surface and a top ring for pressing a substrate against the polishing surface while independently controlling pressing forces applied to a plurality of areas on the substrate. The polishing apparatus has a sensor for monitoring substrate conditions of a plurality of measurement points on the substrate, a monitor unit for performing a predetermined arithmetic process on a signal from the sensor to generate a monitor signal, and a controller for controlling the pressing forces of the top ring based on the monitor signal so as to adjust a sensitivity of the pressing forces applied to the plurality of areas during polishing the substrate.

According to a fifth aspect of the present invention, there is provided a method of polishing a substrate. In this method, a substrate condition of at least one measurement point on a substrate is monitored by a sensor. A predetermined arithmetic process is performed on a signal from the sensor to generate a monitor signal. The monitor signal of the measurement point is compared with a reference signal representing a relationship between a reference value for the monitor signal and time. The substrate is pressed against a polishing surface to polish the substrate while controlling a pressing force applied to at least one area on the substrate so that the monitor signal of the measurement point converges on the reference signal.

According to a sixth aspect of the present invention, there is provided a method of processing a substrate. In this method, a substrate condition of at least one measurement point on a substrate is monitored by a sensor. A predetermined arithmetic process is performed on a signal from the sensor to generate a monitor signal. The monitor signal of the measurement point is compared with a reference signal representing a relationship between a reference value for the monitor signal and time. A film is formed on the substrate while controlling the substrate condition of the substrate so that the monitor signal of the measurement point converges on the reference signal.

According to the present invention, it is possible to accurately control a polishing profile, a polishing time, and a polishing rate of a substrate.

The above and other objects, features, and advantages of the present invention will be apparent from the following description when taken in conjunction with the accompanying drawings which illustrate preferred embodiments of the present invention by way of example.

BRIEF DESCRIPTION OF DRAWINGS

FIG. 25 is a table showing another example of fuzzy rules for a predictive control according to the present invention;

BEST MODE FOR CARRYING OUT THE INVENTION

Figure 1:
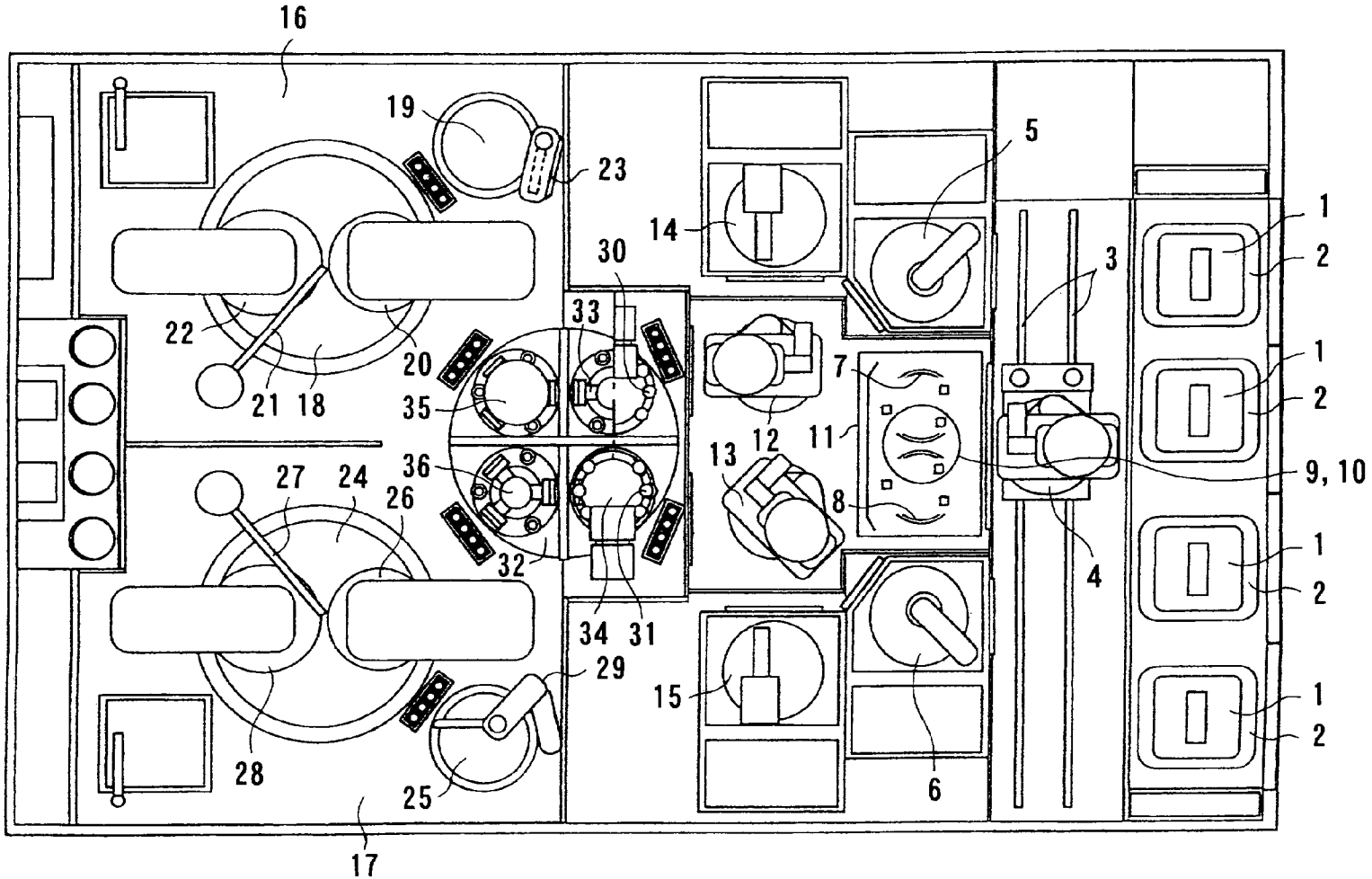
FIG. 1 is a plan view showing a polishing apparatus according to an embodiment of the present invention.

A polishing apparatus according to embodiments of the present invention will be described below with reference to FIGS. 1 through 35. Like or corresponding parts are denoted by like or corresponding reference numerals in FIGS. 1 through 35 and will not be described below repetitively.

FIG. 1 is a plan view showing a polishing apparatus according to an embodiment of the present invention. As shown in FIG. 1, the polishing apparatus has four loading/unloading stages 2 on which wafer cassettes 1 for storing a large number of semiconductor wafers are placed. A traveling mechanism 3 is provided along an array of the loading/unloading stages 2. A first transfer robot 4, which has two hands, is disposed on the traveling mechanism 3. The hands of the first transfer robot 4 are accessible to the respective wafer cassettes 1 on the loading/unloading stages 2.

Two cleaning and drying units 5 and 6 are disposed on an opposite side of the traveling mechanism 3 of the first transfer robot 4 to the wafer cassettes 1. The hands of the first transfer robot 4 are also accessible to the cleaning and drying units 5 and 6. Each of the cleaning and drying units 5 and 6 has a spin-drying function to rotate a wafer at a high speed to dry the wafer. A wafer station 11, which has four placement stages 7, 8, 9, and 10 for semiconductor wafers, is disposed between the two cleaning and drying units 5 and 6. The hands of the first transfer robot 4 are accessible to the wafer station 11.

A second transfer robot 12, which has two hands, is disposed at a position accessible to the cleaning and drying unit 5 and the three placement stages 7, 9, and 10. A third transfer robot 13, which has two hands, is disposed at a position accessible to the cleaning and drying unit 6 and the three placement stages 8, 9, and 10. The placement stage 7 is used to transfer a semiconductor wafer between the first transfer robot 4 and the second transfer robot 12. The placement stage 8 is used to transfer a semiconductor wafer between the first transfer robot 4 and the third transfer robot 13. The placement stage 9 is used to transfer a semiconductor wafer from the second transfer robot 12 to the third transfer robot 13. The placement stage 10 is used to transfer a semiconductor wafer from the third transfer robot 13 to the second transfer robot 12. The placement stage 9 is located above the placement stage 10.

A cleaning unit 14 for cleaning a polished wafer is disposed adjacent to the cleaning and drying unit 5 at a position to which the hands of the second transfer robot 12 are accessible. A cleaning unit 15 for cleaning a polished wafer is disposed adjacent to the cleaning and drying unit 6 at a position to which the hands of the third transfer robot 13 are accessible.

As shown in FIG. 1, the polishing apparatus has two polishing units 16 and 17. Each of the polishing units 16 and 17 has two polishing tables and one top ring for holding a wafer and pressing the wafer against the polishing table to polish the wafer. Specifically, the polishing unit 16 includes a first polishing table 18, a second polishing table 19, a top ring 20, a polishing liquid supply nozzle 21 for supplying a polishing liquid to the first polishing table 18, a dresser 22 for dressing the first polishing table 18, and a dresser 23 for dressing the second polishing table 19. Further, the polishing unit 17 includes a first polishing table 24, a second polishing table 25, a top ring 26, a polishing liquid supply nozzle 27 for supplying a polishing liquid to the first polishing table 24, a dresser 28 for dressing the first polishing table 24, and a dresser 29 for dressing the second polishing table 25.

A reversing machine 30 for reversing a semiconductor wafer is provided at a position to which the hands of the second transfer robot 12 are accessible in the polishing unit 16. The second transfer robot 12 transfers a semiconductor wafer to the reversing machine 30. Similarly, a reversing machine 31 for reversing a semiconductor wafer is provided at a position to which the hands of the third transfer robot 13 are accessible in the polishing unit 17. The third transfer robot 13 transfers a semiconductor wafer to the reversing machine 31.

A rotary transporter 32 for transferring a wafer between the reversing machines 30, 31 and the top rings 20, 26 is disposed below the reversing machines 30, 31 and the top rings 20, 26. The rotary transporter 32 has four stages, on which wafers are placed, at equal intervals. Thus, a plurality of wafers can simultaneously be mounted on the rotary transporter 32. When a wafer is transferred to the reversing machine 30 or 31, and the center of the wafer chucked by the reversing machine 30 or 31 is aligned with the center of the stage in the rotary transporter 32, a lifter 33 or 34 provided below the rotary transporter 32 is raised to transfer the wafer onto the rotary transporter 32.

The wafer transferred to the top ring 20 or 26 is attracted by a vacuum suction mechanism of the top ring 20 or 26. The wafer is transferred to the polishing table 18 or 24 while it is attracted by the vacuum suction mechanism. Then, the wafer is polished by a polishing surface such as a polishing pad or a grinding wheel attached onto the polishing table 18 or 24. Each of the second polishing tables 19 and 25 is disposed at a position to which the top ring 20 or 26 is accessible. Thus, after the wafer is polished by the first polishing table 18 or 24, the wafer can be polished by the second polishing table 19 or 25. The wafer that has been polished is returned to the reversing machine 30 or 31 in the same route as described above.

The wafer returned to the reversing machine 30 or 31 is transferred to the cleaning unit 14 or 15 by the second transfer robot 12 or the third transfer robot 13 and cleaned therein. The wafer cleaned in the cleaning unit 14 or 15 is transferred to the cleaning unit 5 or 6 by the second transfer robot 12 or the third transfer robot 13 and cleaned and dried therein. The wafer cleaned in the cleaning unit 5 or 6 is placed on the placement stage 7 or 8 by the second transfer robot 12 or the third transfer robot 13 and returned into the wafer cassette 1 on the loading/unloading stage 2 by the first transfer robot 4.

Now, the aforementioned polishing units will be described in detail. Since the polishing unit 16 and the polishing unit 17 have the same structure, only the structure of the polishing unit 16 will be described below. The following description is also applicable to the polishing unit 17.

Figure 2:
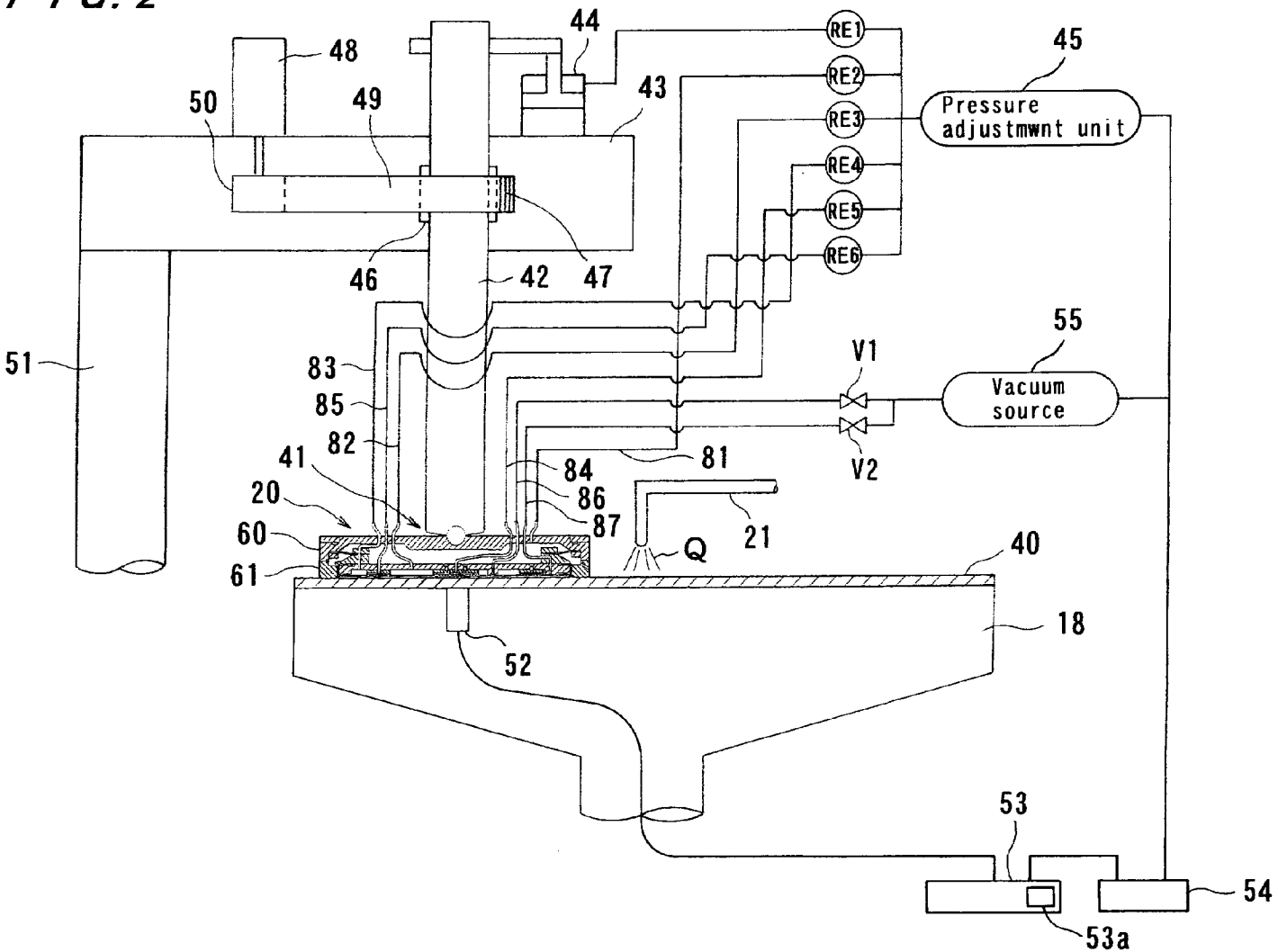
FIG. 2 is a schematic view showing a portion of a polishing unit in the polishing apparatus shown in FIG. 1.

FIG. 2 is a schematic view showing a portion of the polishing unit 16 shown in FIG. 1. As shown in FIG. 2, the polishing table 18, which has an upper surface onto which a polishing pad 40 is attached, is provided below the top ring 20. The polishing liquid supply nozzle 21 is provided above the polishing table 18. A polishing liquid Q is supplied from the polishing liquid supply nozzle 21 to the polishing pad 40 on the polishing table 18. The polishing table 18 is coupled to a motor (not shown), which serves as a driving mechanism for providing relative movement between the polishing table 18 and the top ring 20. Thus, the polishing table 18 is configured to be rotatable.

Various kinds of polishing pads are available on the market. For example, some of these are SUBA800, IC-1000, and IC-1000/SUBA400 (two-layer cloth) manufactured by Rodel Inc., and Surfin xxx-5 and Surfin 000 manufactured by Fujimi Inc. SUBA800, Surfin xxx-5, and Surfin 000 are non-woven fabrics bonded by urethane resin, and IC-1000 is made of rigid polyurethane foam (single layer). Polyurethane foam is porous and has a large number of fine recesses or holes formed in its surface.

The top ring 20 is connected to the top ring shaft 42 via a universal joint 41, and the top ring shaft 42 is coupled to a top ring air cylinder 44 fixed to a top ring head 43. The top ring 20 has a top ring body 60 substantially in the form of a disk and a retainer ring 61 disposed at a peripheral portion of the top ring body 60. The top ring body 60 is coupled to a lower end of the top ring shaft 42.

The top ring air cylinder 44 is connected to a pressure adjustment unit 45 via a regulator RE1. The pressure adjustment unit 45 serves to adjust a pressure by supply of a pressurized fluid such as pressurized air from a compressed air source or by evacuation with pump or the like The air pressure of the pressurized air to be supplied to the top ring air cylinder 44 is adjusted via the regulator RE1 by the pressure adjustment unit 45. The top ring air cylinder 44 moves the top ring shaft 42 vertically to raise and lower the whole top ring 20 and press the retainer ring 61 attached to the top ring body 60 against the polishing table 18 under a predetermined pressing force.

The top ring shaft 42 is coupled to a rotary sleeve 46 by a key (not shown). The rotary sleeve 46 has a timing pulley 47 disposed at a peripheral portion thereof. A top ring motor 48, which serves as a driving mechanism to provide relative movement between the polishing table 18 and the top ring 20, is fixed to the top ring head 43. The timing pulley 47 is connected to a timing pulley 50 mounted on the top ring motor 48 via a timing belt 49. Accordingly, when the top ring motor 48 is energized for rotation, the rotary sleeve 46 and the top ring shaft 42 are rotated in unison with each other via the timing pulley 50, the timing belt 49, and the timing pulley 47 to thereby rotate the top ring 20. The top ring head 43 is supported on a top ring head shaft 51 rotatably supported on a frame (not shown).

As shown in FIG. 2, a sensor 52 for monitoring (detecting) substrate conditions including a film thickness of a semiconductor wafer being polished is embedded in the polishing table 18. The sensor 52 is connected to a monitor unit 53 and a controller 54. Output signals of the sensor 52 are transmitted to the monitor unit 53, where necessary conversion and operation (arithmetic processing) are conducted on the output signals of the sensor 52 to produce monitor signals. The monitor unit 53 has a controller 53*a* for performing control arithmetic based on the monitor signals. The controller 53*a* determines a force for the top ring 20 to press a wafer (pressing force) based on the monitor signals and sends the pressing force to the controller 54. For example, an eddy-current sensor is used as the sensor 52. The controller 54 provided outside of the monitor unit 53 sends commands to the pressure adjustment unit 45 so as to change a pressing force by the top ring 20. The controller 53*a* in the monitor unit 53 and the controller 54 may be integrated so as to form a single controller.

Figure 3:
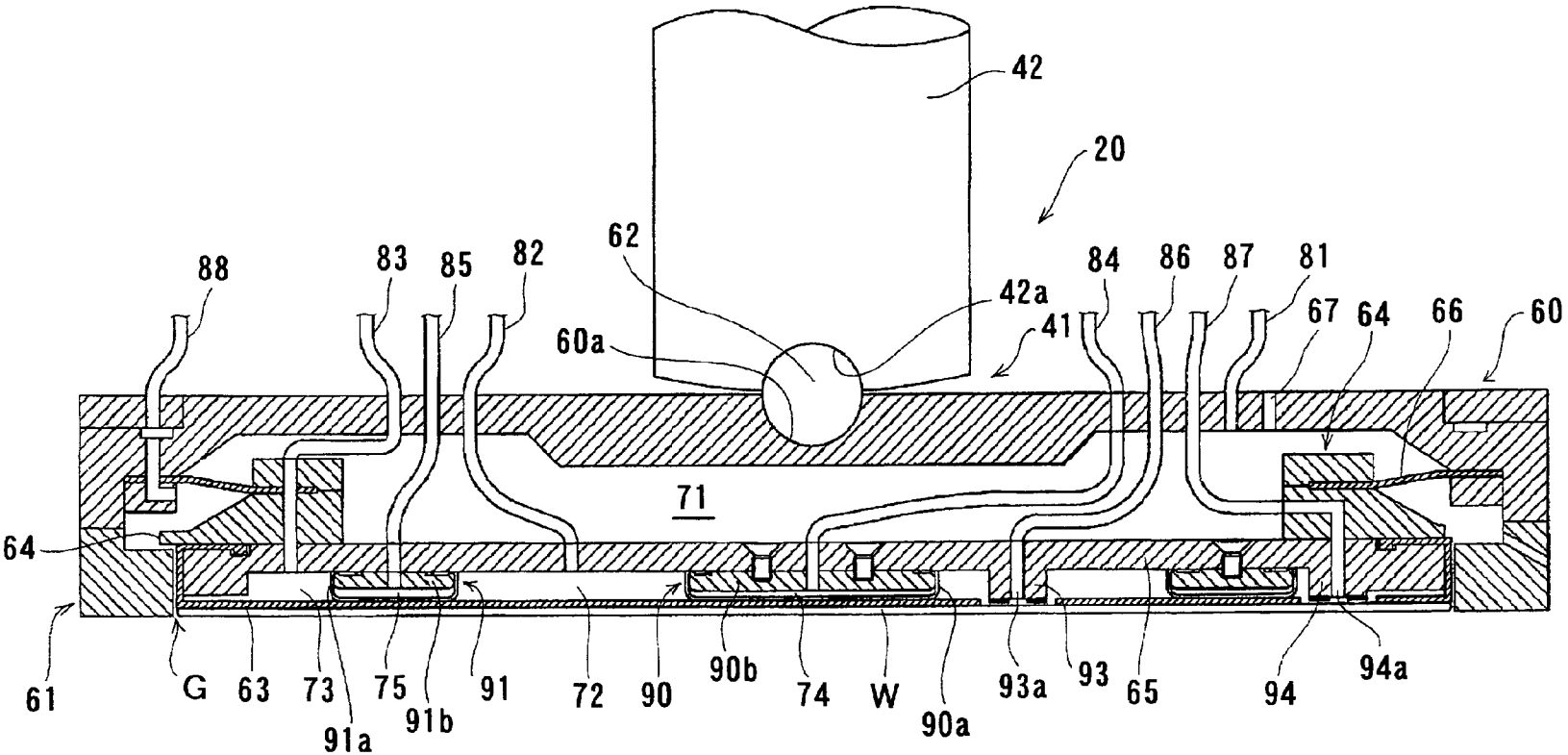
FIG. 3 is a vertical cross-sectional view showing a top ring in the polishing unit shown in FIG. 2.
Figure 4:
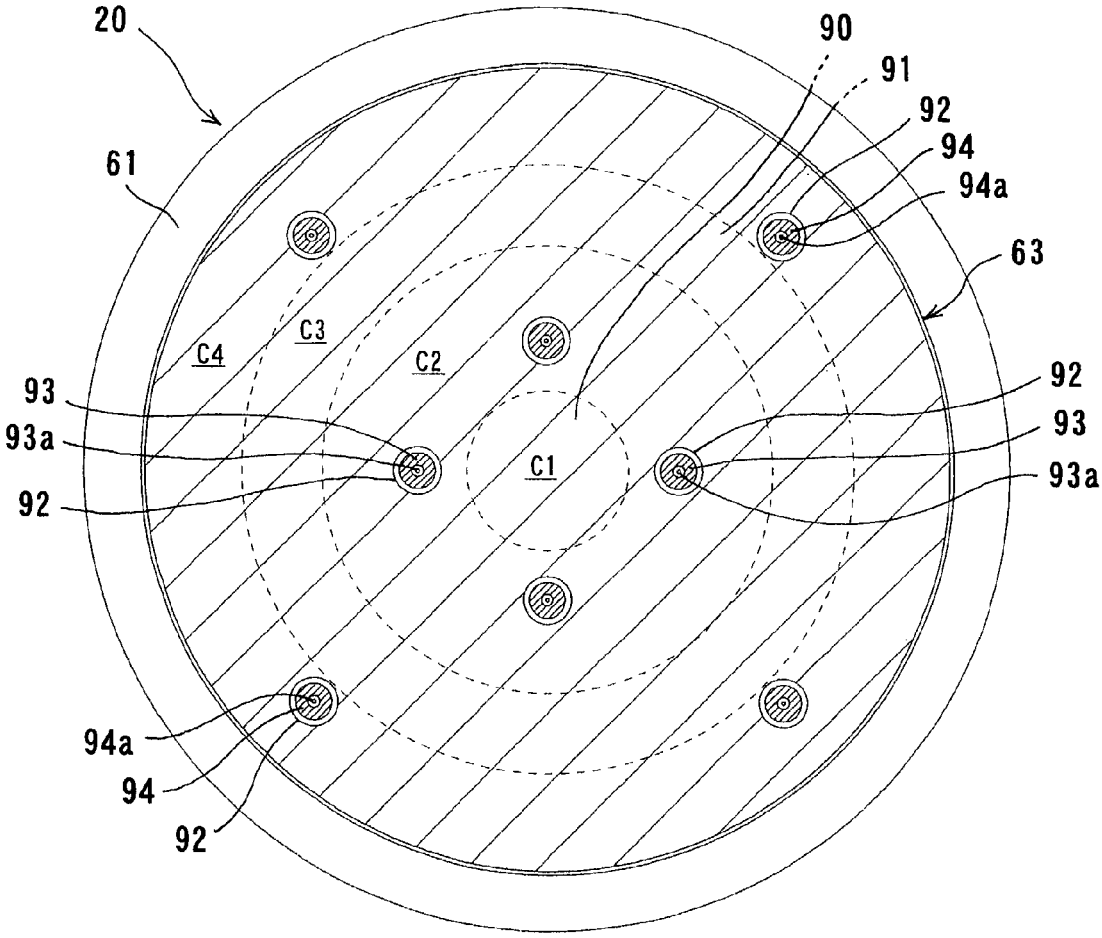
FIG. 4 is a bottom view showing the top ring in the polishing unit shown in FIG. 2.

FIG. 3 is a vertical cross-sectional view showing the top ring 20 shown in FIG. 2, and FIG. 4 is a bottom view of the top ring 20 shown in FIG. 2. As shown in FIG. 3, the top ring 20 has a top ring body 60 in the form of a cylindrical housing with a receptacle space defined therein, and a retainer ring 61 fixed to a lower end of the top ring body 60. The retainer ring 61 has a lower portion projecting radially inward. The top ring body 60 is made of a material having high strength and rigidity, such as metal or ceramics. The retainer ring 61 is made of highly rigid resin, ceramics, or the like. The retainer ring 61 may be formed integrally with the top ring body 60.

The top ring shaft 42 is disposed above a central portion of the top ring body 60, and the top ring body 60 is coupled to the top ring shaft 42 by the universal joint 41. The universal joint 41 has a spherical bearing mechanism by which the top ring body 60 and the top ring shaft 42 are tiltable with respect to each other, and a rotation transmitting mechanism for transmitting rotation of the top ring shaft 42 to the top ring body 60. The spherical bearing mechanism and the rotation transmitting mechanism transmit a pressing force and a rotating force from the top ring shaft 42 to the top ring body 60 while allowing the top ring body 60 and the top ring shaft 42 to be tilted with respect to each other.

The spherical bearing mechanism includes a hemispherical recess 42*a* defined centrally in a lower surface of the top ring shaft 42, a hemispherical recess 60*a* defined centrally in an upper surface of the top ring body 60, and a bearing ball 62 made of a highly hard material such as ceramics and interposed between the recesses 42*a* and 60*a*. Meanwhile, the rotation transmitting mechanism includes drive pins (not shown) fixed to the top ring shaft 42 and driven pins (not shown) fixed to the top ring body 60. Even if the top ring body 60 is tilted with respect to the top ring shaft 42, the drive pins and the driven pins remain in engagement with each other while contact points are displaced because the drive pin and the driven pin are vertically movable relative to each other. Thus, the rotation transmitting mechanism reliably transmits rotational torque of the top ring shaft 42 to the top ring body 60.

The top ring body 60 and the retainer ring 61 have a space defined therein, which accommodates therein an elastic pad 63 brought into contact with the semiconductor wafer W held by the top ring 20, an annular holder ring 64, and a chucking plate 65 substantially in the form of a disk for supporting the elastic pad 63. The elastic pad 63 has a radially outer edge clamped between the holder ring 64 and the chucking plate 65 and extends radially inward so as to cover a lower surface of the chucking plate 65. Thus, a space is defined between the elastic pad 63 and the chucking plate 65.

The chucking plate 65 may be made of metal. However, in a case where an eddy current sensor is used as the sensor 52 to measure the thickness of a thin film formed on a semiconductor wafer W, the chucking plate 65 should preferably be made of a non-magnetic material, e.g., fluororesin such as polytetrafluoroethylene or an insulating material such as ceramics of SiC (silicon carbide), $Al_2O_3$ (alumina), or the like.

A pressurizing sheet 66 comprising an elastic membrane extends between the holder ring 64 and the top ring body 60. The top ring body 60, the chucking plate 65, the holder ring 64, and the pressurizing sheet 66 jointly define a pressure chamber 71 in the top ring body 60. As shown in FIG. 3, a fluid passage 81 comprising tubes and connectors communicates with the pressure chamber 71, which is connected to the pressure adjustment unit 45 via a regulator RE2 (see FIG. 2) provided on the fluid passage 81. The pressurizing sheet 66 is made of a highly strong and durable rubber material such as ethylene propylene rubber (EPDM), polyurethane rubber, or silicone rubber.

A central bag 90 and a ring tube 91 which are brought into contact with the elastic pad 63 are mounted in a space defined between the elastic pad 63 and the chucking plate 65. In the present embodiment, as shown in FIGS. 3 and 4, the central bag 90 is disposed centrally on the lower surface of the chucking plate 65, and the ring tube 91 is disposed radially outward of the central bag 90 in surrounding relation thereto. As with the pressurizing sheet 66, each of the elastic pad 63, the central bag 90, and the ring tube 91 is made of a highly strong and durable rubber material such as ethylene propylene rubber (EPDM), polyurethane rubber, or silicone rubber.

The space defined between the chucking plate 65 and the elastic pad 63 is divided into a plurality of spaces by the central bag 90 and the ring tube 91. Thus, a pressure chamber 72 is defined between the central bag 90 and the ring tube 91, and a pressure chamber 73 is defined radially outward of the ring tube 91.

The central bag 90 includes an elastic membrane 90*a* brought into contact with an upper surface of the elastic pad 63, and a central bag holder 90*b* for detachably holding the elastic membrane 90*a* in position. The central bag 90 has a central pressure chamber 74 defined therein by the elastic membrane 90*a* and the central bag holder 90*b*. Similarly, the ring tube 91 includes an elastic membrane 91*a* brought into contact with the upper surface of the elastic pad 63, and a ring tube holder 91*b* for detachably holding the elastic membrane 91*a* in position. The ring tube 91 has an intermediate pressure chamber 75 defined therein by the elastic membrane 91*a* and the ring tube holder 91*b*.

Fluid passages 82, 83, 84 and 85 comprising tubes and connectors communicate with the pressure chambers 72, 73, 74, and 75, respectively. The pressure chambers 72-75 are connected to the pressure adjustment unit 45 via respective regulators RE3-RE6 connected respectively to the fluid passages 82-85. The fluid passages 81-85 are connected to the respective regulators RE2-RE6 through a rotary joint (not shown) mounted on an upper end of the top ring shaft 42.

The pressure chamber 71 above the chucking plate 65 and the pressure chambers 72-75 are supplied with pressurized fluids such as pressurized air or evacuated, via the fluid passages 81-85 connected to the respective pressure chambers. As shown in FIG. 2, the regulators RE2-RE6 connected to the fluid passages 81-85 of the pressure chambers 71-75 can respectively regulate pressures of the pressurized fluids to be supplied to the respective pressure chambers. Thus, it is possible to independently control the pressures in the pressure chambers 71-75 or independently introduce atmospheric air or vacuum into the pressure chambers 71-75. In this manner, the pressures in the pressure chambers 71-75 are independently varied with the regulators RE2-RE6, so that the pressing forces to press the semiconductor wafer W via the elastic pad 63 against the polishing pad 40 can be adjusted in local areas (divided areas) of the semiconductor wafer W. In some applications, the pressure chambers 71-75 may be connected to a vacuum source 55 (see FIG. 2).

In this case, the fluids supplied to the pressure chambers 72-25 may independently be controlled in temperature. With this configuration, it is possible to directly control the temperature of a substrate such as a semiconductor wafer from the backside of the surface to be polished. Particularly, when each of the pressure chambers is independently controlled in temperature, a rate of chemical reaction can be controlled in a chemical polishing process of CMP.

As shown in FIG. 4, the elastic pad 63 has a plurality of openings 92. Inner suction portions 93 project downward from the chucking plate 65 so as to be exposed through the respective openings 92 which are positioned between the central bag 90 and the ring tube 91. Outer suction portions 94 project downward from the chucking plate 65 so as to be exposed through the respective openings 92 which are positioned radially outward of the ring tube 91. In this embodiment, the elastic pad 63 has eight openings 92, and the suction portions 93 and 94 are exposed through these openings 92.

The suction portions 61 and 62 have communication holes 93*a* and 94*a* communicating with fluid passages 86 and 87, respectively. As shown in FIG. 2, the suction portions 93 and 94 are connected to the vacuum source 55 such as a vacuum pump via the fluid passages 86 and 87 and valves V1 and V2. When the communication holes 93*a* and 94*a* of the suction portions 93 and 94 are connected to the vacuum source 55, a negative pressure is developed at lower opening ends of the communication holes 93*a* and 94*a* to attract a semiconductor wafer W to the lower ends of the suction portions 93 and 94.

As shown in FIG. 3, while the semiconductor wafer W is being polished, the suction portions 93 and 94 are positioned above the lower surface of the elastic pad 63, and thus do not project from the lower surface of the elastic pad 63. When attracting the semiconductor wafer W, the lower end surfaces of the suction portions 93 and 94 are positioned substantially in the same plane as the lower surface of the elastic pad 63.

Since there is a small gap G between an outer circumferential surface of the elastic pad 63 and the inner circumferential surface of the retainer ring 61, the holder ring 64, the chucking plate 65, and the elastic pad 63 attached to the chucking plate 65 can be moved vertically with respect to the top ring body 60 and the retainer ring 61, and hence are of a floating structure with respect to the top ring body 60 and the retainer ring 61. The holder ring 64 has a plurality of projections 64*a* projecting radially outward from the outer circumferential edge of a lower portion of the holder ring 64. Downward movement of the members including the holder ring 64 is limited to a predetermined range by engaging the projections 64*a* with an upper surface of the radially inward projecting portion of the retainer ring 61.

A fluid passage 88 is defined in an outer circumferential edge of the top ring body 60. A cleaning liquid (pure water) is supplied via the fluid passage 88 into the gap G between the outer circumferential surface of the elastic pad 63 and the inner circumferential surface of the retainer ring 61.

In the polishing apparatus thus constructed, when a semiconductor wafer W is to be held by the top ring 20, the communication holes 93*a* and 94*a* of the suction portions 93 and 94 are connected via the fluid passages 86 and 87 to the vacuum source 55. Thus, the semiconductor wafer W is attracted under vacuum to the lower ends of the suction portions 93 and 94 by suction effect of the communication holes 93*a* and 94*a*. With the semiconductor wafer W attracted to the top ring 20, the entire top ring 20 is moved to a position above the polishing surface (polishing pad 40). The outer circumferential edge of the semiconductor wafer W is held by the retainer ring 61 so that the semiconductor wafer W is not separated from the top ring 20.

For polishing the semiconductor wafer, the attraction of semiconductor wafer W by the suction portions 93 and 94 is released, and the semiconductor wafer W is held on the lower surface of the top ring 20. Simultaneously, the top ring air cylinder 44 is actuated to press the retainer ring 61 fixed to the lower end of the top ring 20 against the polishing pad 40 on the polishing table 18 under a predetermined pressure. In such a state, pressurized fluids are respectively supplied to the pressure chambers 72-75 under respective pressures, thereby pressing the semiconductor wafer W against the polishing surface on the polishing table 18. The polishing liquid supply nozzle 21 supplies a polishing liquid Q onto the polishing pad 40, so that the polishing liquid Q is held on the polishing pad 40. Thus, the semiconductor wafer W is polished with the polishing liquid Q being present between the (lower) surface, to be polished, of the semiconductor wafer W and the polishing pad 40.

The local areas of the semiconductor wafer W that are positioned beneath the pressure chambers 72 and 73 are pressed against the polishing surface under the pressures of the pressurized fluids supplied to the pressure chambers 72 and 73. The local area of the semiconductor wafer W that is positioned beneath the central pressure chamber 74 is pressed via the elastic membrane 90*a* of the central bag 90 and the elastic pad 63 against the polishing surface under the pressure of the pressurized fluid supplied to the central pressure chamber 74. The local area of the semiconductor wafer W that is positioned beneath the pressure chamber 75 is pressed via the elastic membrane 91*a* of the ring tube 91 and the elastic pad 63 against the polishing surface under the pressure of the pressurized fluid supplied to the pressure chamber 75.

Therefore, the polishing pressures (pressing forces) acting on the respective local areas of the semiconductor wafer W can be adjusted independently in the radial direction by controlling the pressures of the pressurized fluids supplied to the respective pressure chambers 72-75. Specifically, the controller 54 (see FIG. 2) independently regulates the pressures of the pressurized fluids supplied to the pressure chambers 72-75 via the respective regulators RE3-RE6 based on the output of the sensor 52 to thereby adjust the pressing forces applied to press the local areas of the semiconductor wafer W against the polishing pad 40 on the polishing table 18. With the polishing pressures on the respective local areas of the semiconductor wafer W being adjusted independently to desired values, the semiconductor wafer W is pressed against the polishing pad 40 on the upper surface of the polishing table 18 that is being rotated. Similarly, the pressure of the pressurized fluid supplied to the top ring air cylinder 44 can be regulated by the regulator RE1 to change a pressing force for the retainer ring 61 to press the polishing pad 40.

Thus, while the semiconductor wafer W is being polished, the pressing force for the retainer ring 61 to press the polishing pad 40 and the pressing force to press the semiconductor wafer W against the polishing pad 40 can appropriately be adjusted so as to apply polishing pressures in a desired pressure distribution to a central area (C1 in FIG. 4), an area (C2) between the central area and an intermediate area, an outer area (C3), a peripheral area (C4) of the semiconductor wafer W, and a peripheral portion of the retainer ring 61 which is positioned outside of the semiconductor wafer W.

The portion of the semiconductor wafer W that is positioned beneath the pressure chambers 72 and 73 includes two areas. One of them is pressed via the elastic pad 64 by the pressurized fluid. The other of them, for example, an area around the openings 92, is pressed directly by the pressurized fluid. These two areas may be pressed under the same pressing force or under respective desired pressures. Since the elastic pad 63 is held in intimate contact with the reverse side of the semiconductor wafer W around the openings 92, the pressurized fluids in the pressure chambers 72 and 73 hardly leak to the exterior of the pressure chambers 72 and 73.

When the polishing of the semiconductor wafer W is finished, the semiconductor wafer W is attracted to the lower ends of the suction portions 93 and 94 under vacuum in the same manner as described above. At that time, the supply of the pressurized fluids into the pressure chambers 72-75 to press the semiconductor wafer W against the polishing surface is stopped, and the pressure chambers 72-75 are vented to the atmosphere. Accordingly, the lower ends of the suction portions 93 and 94 are brought into contact with the semiconductor wafer W. The pressure chamber 71 is vented to the atmosphere or evacuated to develop a negative pressure therein. If the pressure chamber 71 is maintained at a high pressure, then the semiconductor wafer W is strongly pressed against the polishing surface only at areas that are brought into contact with the suction portions 93 and 94. Therefore, it is necessary to immediately decrease the pressure in the pressure chamber 71. Accordingly, as shown in FIG. 3, a relief port 67 penetrating from the pressure chamber 71 through the top ring body 60 may be provided for immediately decreasing the pressure in the pressure chamber 71. In this case, when the pressure chamber 71 is pressurized, it is necessary to continuously supply the pressurized fluid into the pressure chamber 71 via the fluid passage 81. The relief port 67 has a check valve for preventing an outside air from flowing into the pressure chamber 71 at the time when a negative pressure is developed in the pressure chamber 71.

After attraction of the semiconductor wafer W, the entire top ring 20 is moved to a position at which the semiconductor wafer is to be transferred, and then a fluid (e.g., compressed air or a mixture of nitrogen and pure water) is ejected to the semiconductor wafer W via the communication holes 93*a* and 94*a* of the suction portions 93 and 94 to release the semiconductor wafer W from the top ring 20.

Figure 5:
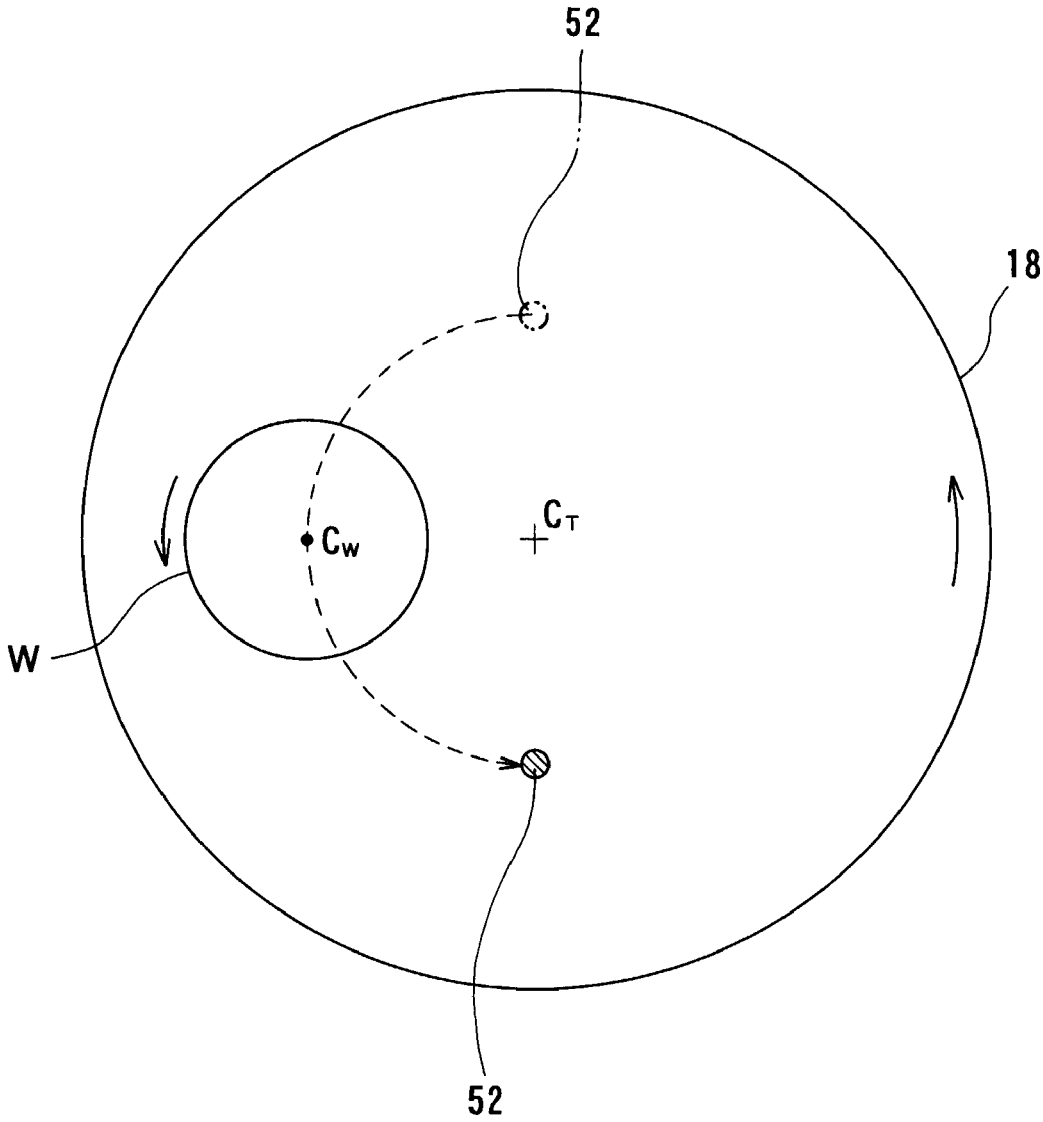
FIG. 5 is a plan view showing a relationship between a polishing table and a semiconductor wafer in the polishing unit shown in FIG. 2.

FIG. 5 is a plan view showing a relationship between the polishing table 18 and the semiconductor wafer W in the polishing unit 16 shown in FIG. 2. As shown in FIG. 5, the sensor 52 is provided at a position that passes through the center $C_w$ of the semiconductor wafer W held by the top ring 20 during polishing. The reference character $C_T$ represents a rotation center of the polishing table 18. For example, the sensor 52 can continuously detect an amount increasing or decreasing according to a film thickness of a conductive film such as Cu layer of the semiconductor wafer W or changes of the film thickness on a passage track (scanning line) while the sensor 52 is passing below the semiconductor wafer W.

Figure 6:
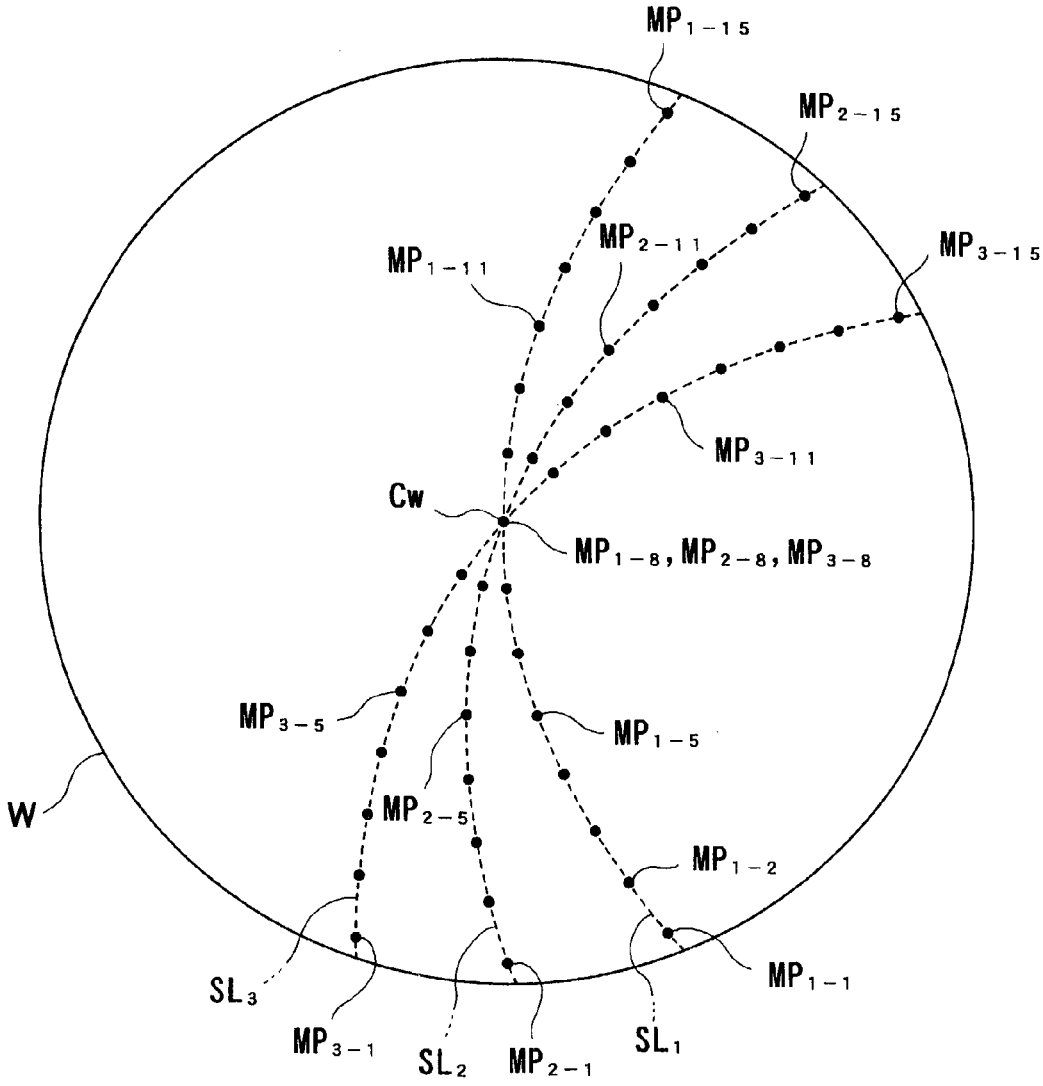
FIG. 6 is a plan view showing trace lines on which a sensor in the polishing unit shown in FIG. 2 scans a semiconductor wafer.

FIG. 6 shows track lines on which the sensor 52 scans the semiconductor wafer W. Specifically, the sensor 52 scans a surface (surface to be polished) of the wafer each time the polishing table 18 makes one revolution. When the polishing table 18 is rotated, the sensor follows a track passing near the center $C_W$ of the wafer W (center of the top ring shaft 42) and scans the surface of the wafer W. Because the rotational speed of the top ring 20 is generally different from the rotational speed of the polishing table 18, tracks of the sensor 52 vary on the wafer W according to rotation of the polishing table 18 as shown by scanning lines $SL_1$, $SL_2$, $SL_3$, . . . in FIG. 6. However, as described above, since the sensor 52 is located at the position that passes through the center $C_W$ of the wafer W, the tracks of the sensor 52 pass through the center $C_W$ of the wafer W in every rotation. In the present embodiment, timing of measurement with the sensor 52 is adjusted so that the center $C_W$ of the wafer W is always measured by the sensor 52 in every rotation.

Further, there has been known the fact that a profile of a surface of a polished wafer W is generally axisymmetric with respect to an axis that is perpendicular to the surface of wafer W and extends through the center $C_W$ of the wafer W. Accordingly, as shown in FIG. 6, when an nth measurement point on an mth scanning line $SL_m$ is represented by $MP_{m-n}$, transition of the film thickness of the wafer W can be monitored at a radial position of nth measurement points by tracking monitor signals of nth measurement points $MP_{1-n}$, $MP_{2-n}$, . . . , $MP_{m-n}$ on respective scanning lines.

In FIG. 6, for the sake of simplification, the number of the measurement points is 15 in one scanning. However, the number of the measurement points is not limited to the illustrated example and can be various values depending upon the period of measurement and the rotational speed of the polishing table 18. When an eddy-current sensor is used as the sensor 52, there are generally at least 100 measurement points on one scanning line. When there are many measurement points, either one of the measurement points approximately accords with the center $C_W$ of the wafer W. Accordingly, the aforementioned adjustment of timing for the center $C_W$ of the wafer W is not required.

Figure 7:
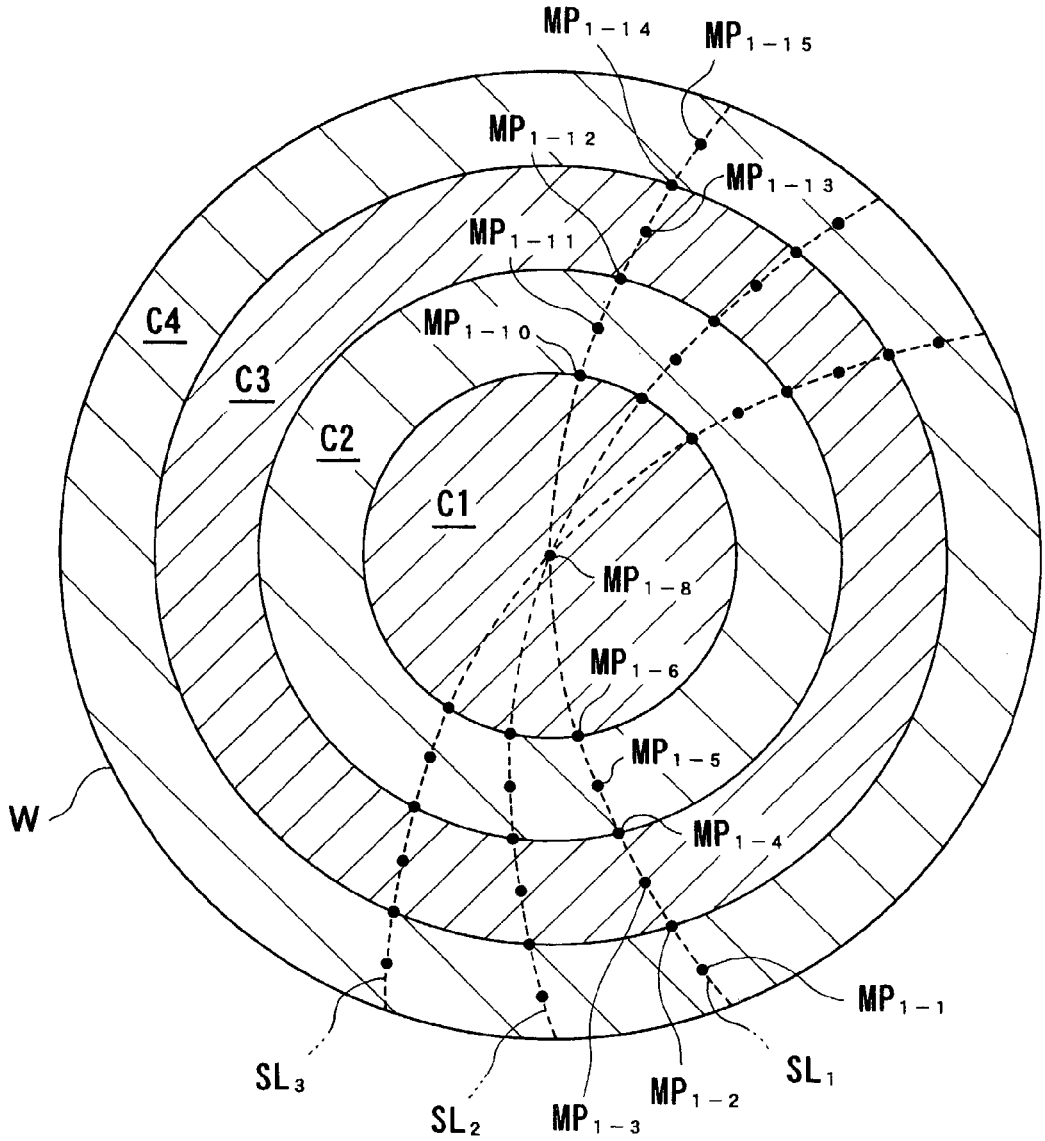
FIG. 7 is a plan view showing an example in which measurement points to be monitored are selected among measurement points on the semiconductor wafer shown in FIG. 6.

FIG. 7 is a plan view showing an example in which measurement points to be monitored by the monitor unit 53 are selected among measurement points on the semiconductor wafer W shown in FIG. 6. In the example shown in FIG. 7, the monitor unit 53 monitors the measurement points $MP_{m-1}$, $MP_{m-2}$, $MP_{m-3}$, $MP_{m-4}$, $MP_{m-5}$, $MP_{m-6}$, $MP_{m-7}$, $MP_{m-8}$, $MP_{m-9}$, $MP_{m-10}$, $MP_{m-11}$, $MP_{m-12}$, $MP_{m-13}$, $MP_{m-14}$, and $MP_{m-15}$, located near the centers and boundary lines of the areas C1, C2, C3, and C4, which are independently controlled in pressing force as described in connection with FIG. 4. Unlike the example shown in FIG. 6, another measurement point may be provided between the measurement points $MP_{m-i}$ and $MP_{m-(i+1)}$. Selection of measurement points to be monitored is not limited to the example shown in FIG. 7. Points to be monitored in view of control can arbitrarily be selected as measurement points to be monitored on a surface of a wafer W to be polished.

The monitor unit 53 performs a predetermined arithmetic process on output signals (sensing signals) of the selected measurement points, which is outputted from the sensor 52, to produce monitor signals and provides the monitor signals to the controller 53*a* (see FIG. 2). The controller 53*a* determines pressure set values of the pressure chambers 74, 72, 75, and 73 in the top ring 20, which correspond to the areas C1, C2, C3, and C4 of the wafer W, based on the provided monitor signals and a reference signal, which is described later, and sends the pressure set values to the controller 54 (see FIG. 2). Thus, pressing forces are adjusted for the areas C1, C2, C3, and C4 of the wafer W.

In order to remove adverse effects of noise to obtain smoothed data, monitor signals of neighboring measurement points may be averaged. Alternatively, the surface of the wafer W may be concentrically divided into a plurality of areas based on radii from the center $C_W$ of the wafer W. Average values or representative values of monitor signals at measurement points in respective areas may be calculated and used as new monitor signals for control. Such configuration is effective in a case where a plurality of sensors are arrayed in the radial direction of the polishing table 18, or in a case where the top ring 20 is swung about the top ring head shaft 51 during polishing.

Figure 8:
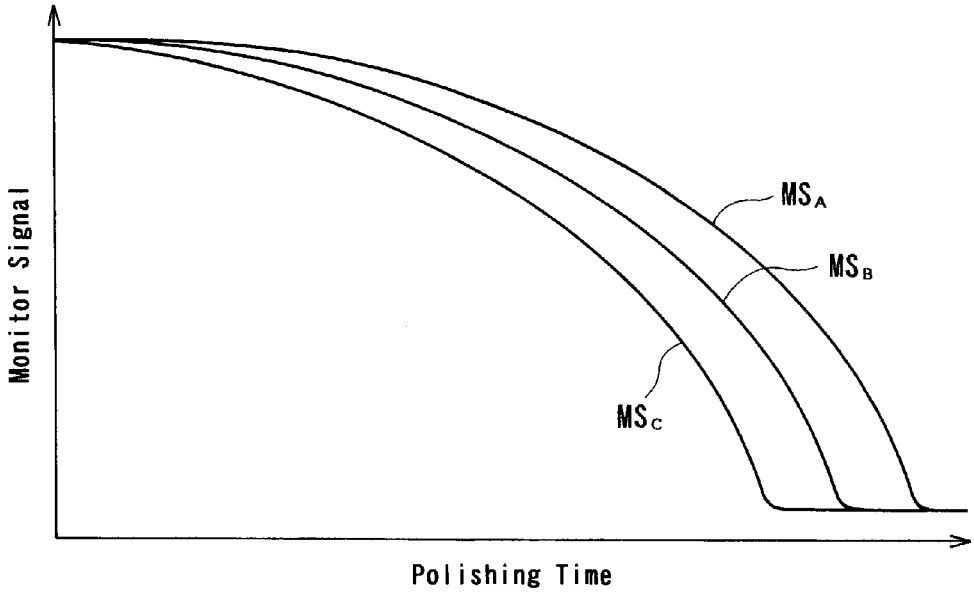
FIG. 8 is a graph showing changes of monitor signals when a metal film of a wafer is polished.

FIG. 8 is a graph showing changes of monitor signals when a metal film of a wafer W is polished while pressing forces to the areas C1, C2, C3, and C4 of the wafer W are maintained at constant values. FIG. 8 shows a monitor signal $MS_A$ corresponding to the measurement points $MP_{m-1}$ and $MP_{m-15}$ (wafer edge portion), a monitor signal $MS_B$ corresponding to the measurement points $MP_{m-5}$ and $MP_{m-11}$ (wafer intermediate portion), and a monitor signal $MS_C$ corresponding to the measurement point $MP_{m-8}$ (wafer center).

In the example shown in FIG. 8, the respective monitor signals decrease gently at an initial stage of polishing. Then, gradients of decrease become large. The respective monitor signals become substantially constant at a polishing endpoint (removal of the metal film). Assuming that initial film thicknesses are different at local points of the wafer W, even if the local points are polished at the same polishing rate, as shown in FIG. 8, the monitor signal values and timing of the polishing endpoints are different depending upon measurement points. In the present embodiment, a predetermined reference signal which represents a relationship between reference values to monitor signals and time is prepared, and the monitor signals are controlled so as to converge on the reference signal.

Figure 9:
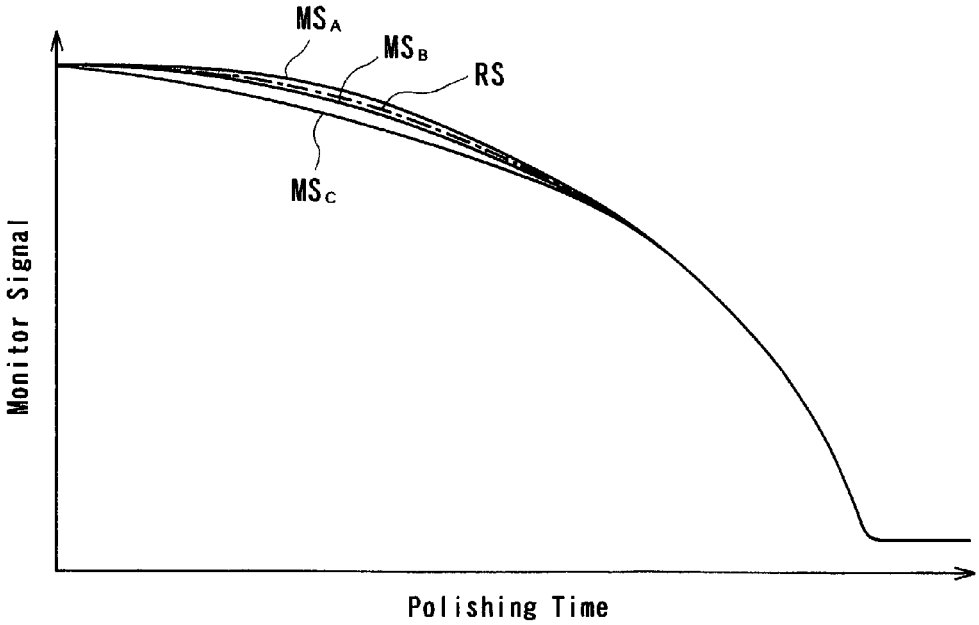
FIG. 9 is a graph showing changes of monitor signals according to a polishing method of the present invention.

FIG. 9 is a graph showing changes of monitor signals when the aforementioned control method is employed to polish a wafer W. During polishing, pressing forces to the areas C1, C2, C3, and C4 of the wafer W are controlled so that the monitor signals $MS_A$, $MS_B$, and $MS_C$ of the local points and the monitor signals of unshown other points converge on the reference signal RS. Accordingly, the monitor signals $MS_A$, $MS_B$, and $MS_C$ of the local points approximately converge on the same variation curve, and polishing end points accord with each other at all local points. Therefore, it is possible to achieve a polishing process having high uniformity of film thickness with respect to the radial direction of the wafer W (hereinafter referred to as a within wafer uniformity) irrespective of conditions of the apparatus such as the polishing pad 40.

Polishing rates vary according to physical properties of a film to be polished, types of a polishing liquid (slurry), the thickness of the polishing pad 40, the temperature of the polishing pad 40 or the wafer W, a laminated structure or an interconnection structure of the film to be polished, and the like. Accordingly, the reference signal also varies according to the aforementioned conditions. The controller 54 or the monitor unit 53 includes a database of reference signals which correspond to physical properties of a film to be polished, types of a polishing liquid (slurry), the thickness of the polishing pad 40, the temperature of the polishing pad 40 or the wafer W, a laminated structure or an interconnection structure of the film to be polished, and the like. When an operator inputs conditions suitable for wafers to be polished, an optimal reference signal is read. Alternatively, when wafers W have the same specification, polishing conditions such as rotational speeds of the polishing table 18 and the top ring 20, types of the polishing liquid and the polishing pad 40, and the like are generally fixed. Therefore, sample wafers having the same specification may be polished to obtain a reference signal.

Figure 10:
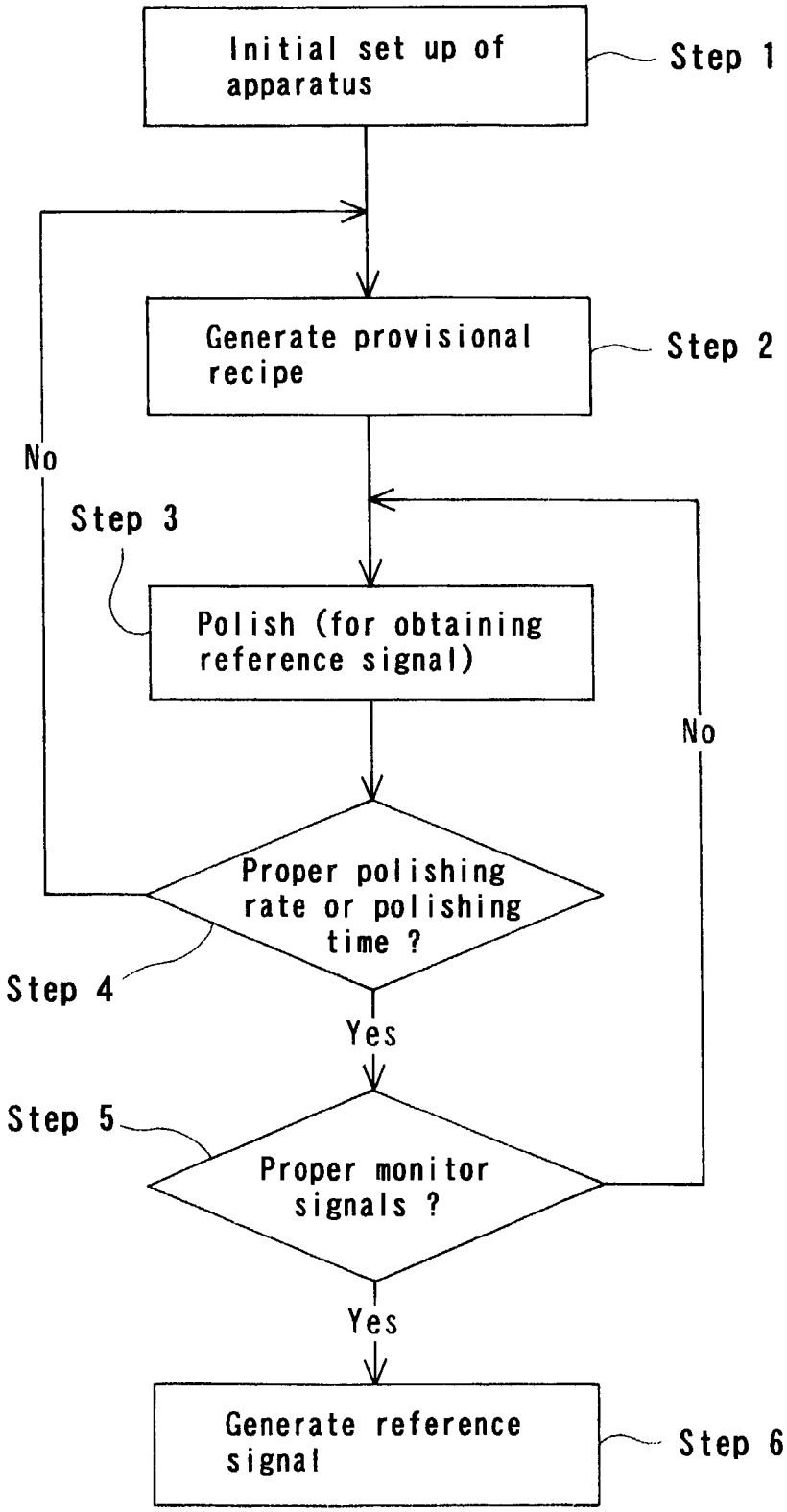
FIG. 10 is a flow chart showing processes of determining a reference signal according to the present invention.

FIG. 10 is a flow chart showing an example of a method of determining a reference signal. In the example shown in FIG. 10, determination of a reference signal is performed before starting a polishing process of a wafer W. First, the top ring 20, the dresser 22, the polishing pad 40, the polishing liquid, and the like having desired specifications are set at an initial setup of the apparatus. Timing of measurement with the sensor 52 is adjusted as described above (Step 1).

Then, a provisional recipe in which polishing conditions are determined for a wafer W to be polished is generated based on experiences or the like (Step 2). In this provisional recipe, pressing forces to the areas C1, C2, C3, and C4, and a pressure of the retainer ring 61 as well as rotational speeds of the polishing table 18 and the top ring 20 are made constant. The wafer W is polished based on the provisional recipe to obtain monitor signals as shown in FIG. 8 (Step 3).

It is judged whether or not a polishing rate or a polishing time of the wafer W is proper (Step 4). If the polishing rate or the polishing time is greatly different from a desired value, the provisional recipe is modified, and a polishing process is repeated. When a wafer W is polished within a desired period of time, it is judged whether or not the monitor signals are proper from the viewpoint of repeatability, noise, and the like (Step 5). If the monitor signals are proper, signals of appropriate points are extracted to generate a reference signal. The reference signal is recorded in a storage device (not shown) such as a hard disk (Step 6). If the monitor signals involve a problem, a polishing process is retried after a cause of the problem has been removed.

At that time, if the thickness of a film on a surface of a substrate to be polished is the same, it is desirable that output signals of the sensor 52 are approximately constant irrespective of a distance between the sensor 52 and the wafer W. Alternatively, it is desirable that an arithmetic process is determined to calculate monitor signals from the output signals of the sensor 52 so that the monitor signals are approximately constant irrespective of a distance between the sensor 52 and the wafer W. However, when output signals of the sensor 52 and monitor signals vary according to a distance between the sensor 52 and the wafer W, i.e., wear of the polishing pad 40, to such a degree that the influence is not negligible, the reference signal may be set as follows. Immediately or shortly after a polishing pad has been replaced, monitor signals of appropriate points on a wafer having the same specification that was polished immediately or shortly after a polishing pad having the same specification was replaced are set as reference signals. When a predetermined number of wafers have been polished after a polishing pad was replaced, monitor signals of appropriate points on a wafer that was just polished or was polished a little while ago with the same polishing pad being used are set as reference signals.

With regard to points on a wafer which are used to obtain monitor signals as reference signals, it is desirable to employ points that are subjected to less changes of pressing forces applied thereto because useless manipulated variables can be reduced at the time of control.

Figure 11:
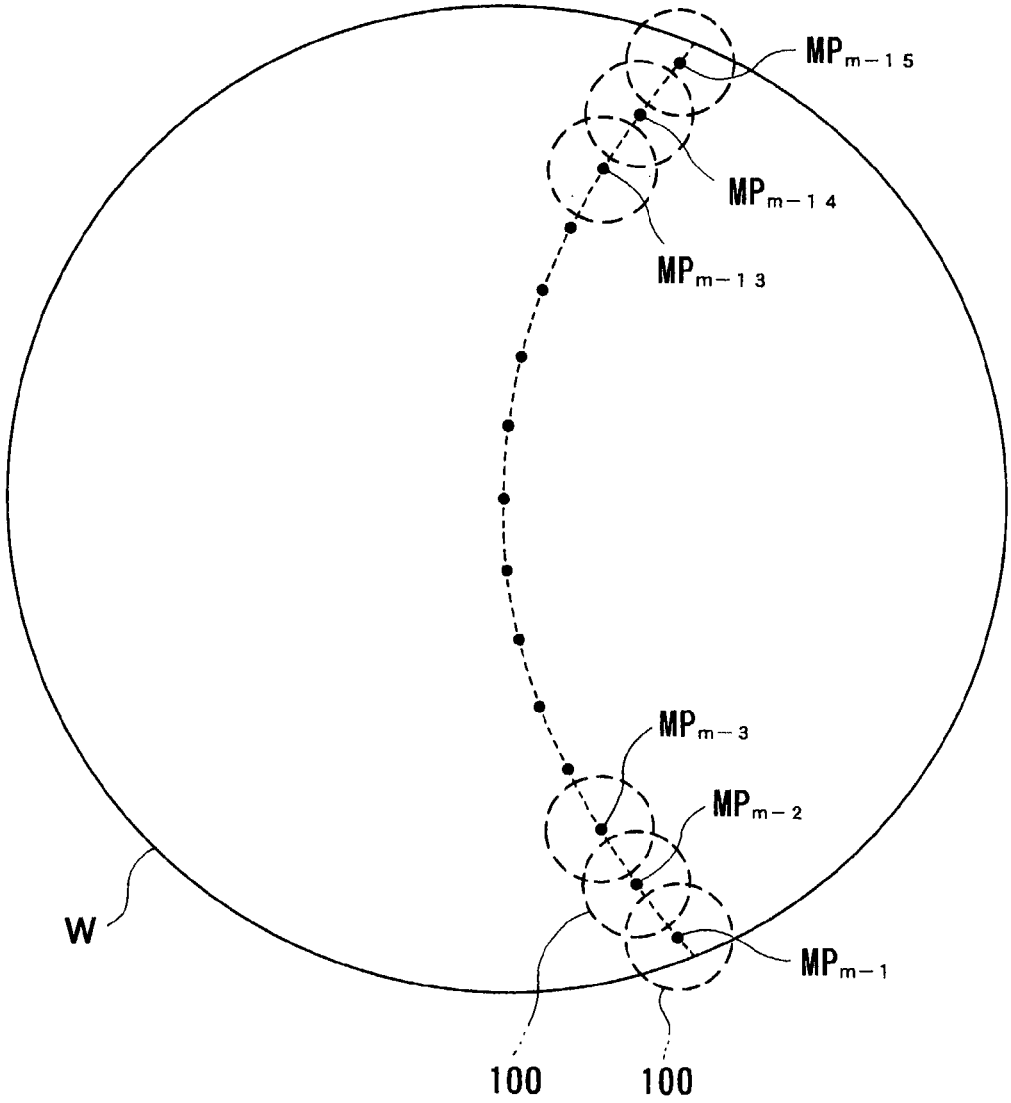
FIG. 11 is a plan view showing effective measurement ranges of the sensor shown in FIG. 2.
Figure 12:
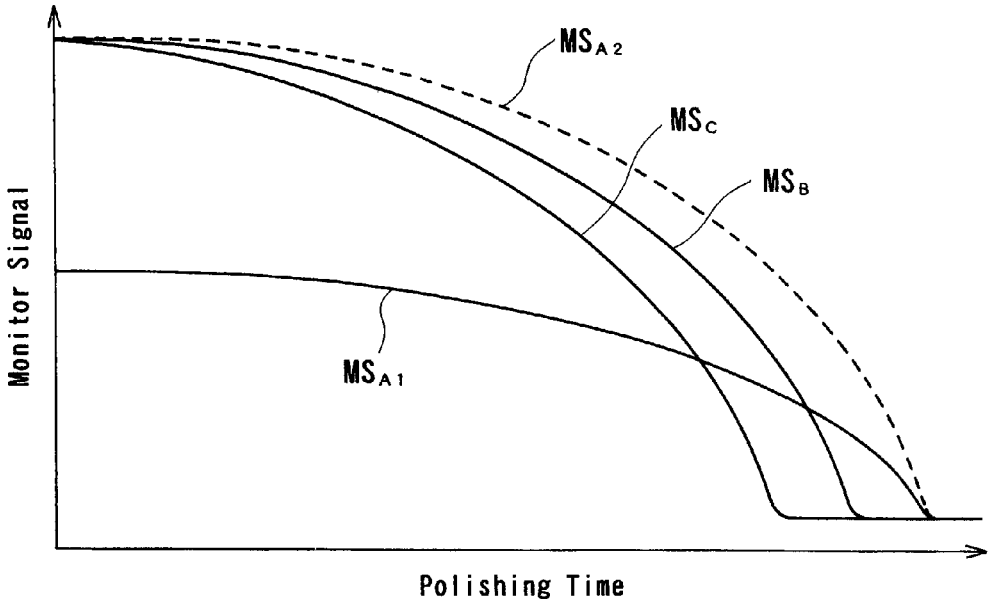
FIG. 12 is a graph showing an example of application of a reference signal according to the present invention.

FIG. 11 is a plan view showing effective measurement ranges of the sensor at the respective measurement points. For example, in the case of an eddy-current sensor, an effective measurement range on a wafer is determined by a size of a coil in the sensor, a divergence angle of an effective range, and a distance from the sensor 52 to the wafer W. Information within ranges shown by small circles 100 in FIG. 11 is obtained at the respective measurement points. Accordingly, when the vicinity of an outer peripheral edge of the wafer W is to be measured, a portion of an effective measurement range of the sensor is located outside of a surface of the wafer W to be polished (see the measurement points $MP_{m-1}$ and $MP_{m-15}$ in FIG. 11). For example, as shown in FIG. 12, a monitor signal $MS_{A1}$ corresponding to the measurement points $MP_{m-1}$ and $MP_{m-15}$ at wafer edge portions becomes smaller than monitor signals $MS_B$ and $MS_C$ of the other points. Thus, the film thickness of a film to be polished is underestimated. With regard to other types of sensors which are described later, a similar phenomenon may occur under some conditions.

In such a case, measurement points at which accurate monitor signals cannot be obtained are excluded at the time of control. In the example shown in FIG. 11, the measurement points $MP_{m-1}$ and $MP_{m-15}$ at edge portions of the wafer W are excluded at the time of control. Specifically, monitor signals of these measurement points are excluded from a controlled system. Although uniformity of the film thickness is not guaranteed in the outer peripheral edge of the wafer W, uniformity of the film thickness can be improved in other areas of the wafer W.

Alternatively, in this case, monitor signals of wafer edge portions may be corrected by the following equation (1).

$$y(r,y_{raw})=c(r,y_{raw})\cdot(y_{raw}-y_0)+y_0 \quad (1)$$

In the equation (1), $y(r, y_{raw})$ represents a corrected monitor signal value, r a distance from the center $C_W$ of the wafer to the measurement point, $y_{raw}$ a monitor signal value to be corrected, $c(r, y_{raw})$ a correction coefficient, and $y_0$ a monitor signal value when the film thickness is zero. A correction coefficient $c(r, y_{raw})$ is determined by interpolation based on correction coefficients experimentally calculated for representative values of the radius r and the monitor signal $y_{raw}$ to be converted. Thus, the monitor signals are corrected as shown by $MS_{A2}$ in FIG. 12. Accordingly, even if accurate monitor signals cannot be obtained at the wafer edge portions, the within wafer uniformity can be improved including the wafer edge portions.

In addition to the sensor having the above structure, for example, in consideration of variation of a polishing rate due to temperature, a non-contact thermometer may be provided to measure the temperature of points of the polishing cloth right after the polishing cloth is brought into slide contact with the wafer.

Figure 13:
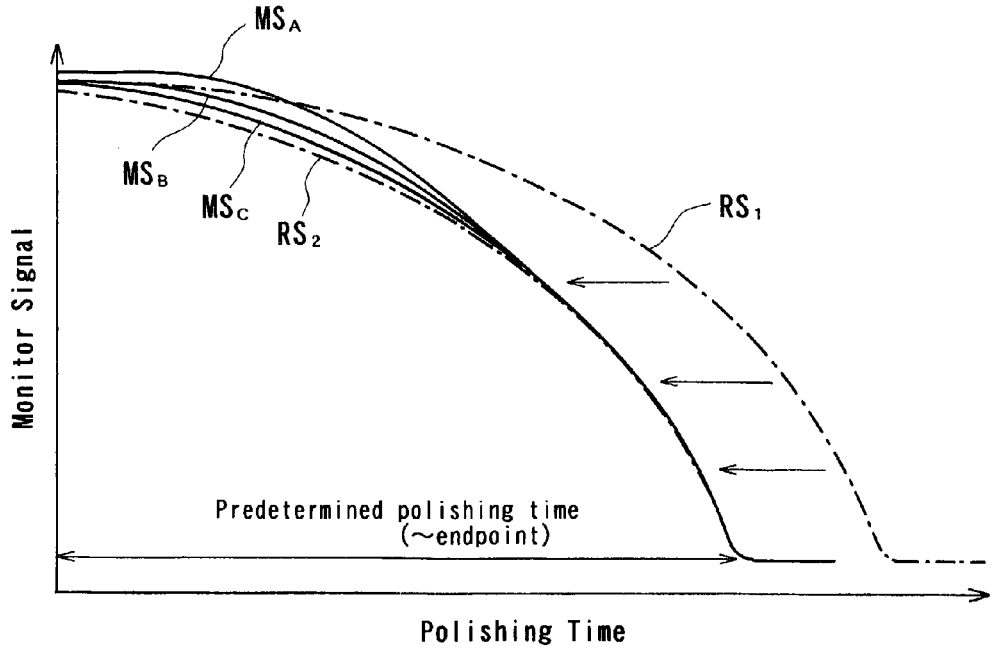
FIG. 13 is a graph showing another example of application of a reference signal according to the present invention.

FIG. 13 is a graph showing an example of application of a reference signal. In FIG. 13, at the beginning of a polishing process or a control process, a reference signal $RS_1$ is translated in parallel along a time series to generate a new reference signal $RS_2$ so that a polishing time until a polishing endpoint has a desired value. If the reference signal $RS_1$ has a desired polishing time until the polishing endpoint at the beginning of the polishing process or the control process, the amount of parallel translation may be zero.

Then, the reference signal $RS_2$ is fixed with respect to the time series. The monitor signals $MS_A$, $MS_B$, and $MS_C$ and monitor signals of unshown other points are controlled so as to converge on the reference signal $RS_2$. In this manner, the within wafer uniformity can be improved irrespective of an initial film thickness profile. Simultaneously, even if wafers have variations in initial film thickness, or even if the apparatus has variations in conditions such as a polishing pad, a period of time until a polishing endpoint is expected to be a predetermined value. Thus, if the polishing time can be made constant, wafers can be transferred approximately in a constant period, which can be expected, in the polishing apparatus. Accordingly, since transfer is not delayed by a wafer having a long polishing time, a throughput can be improved.

Figure 14:
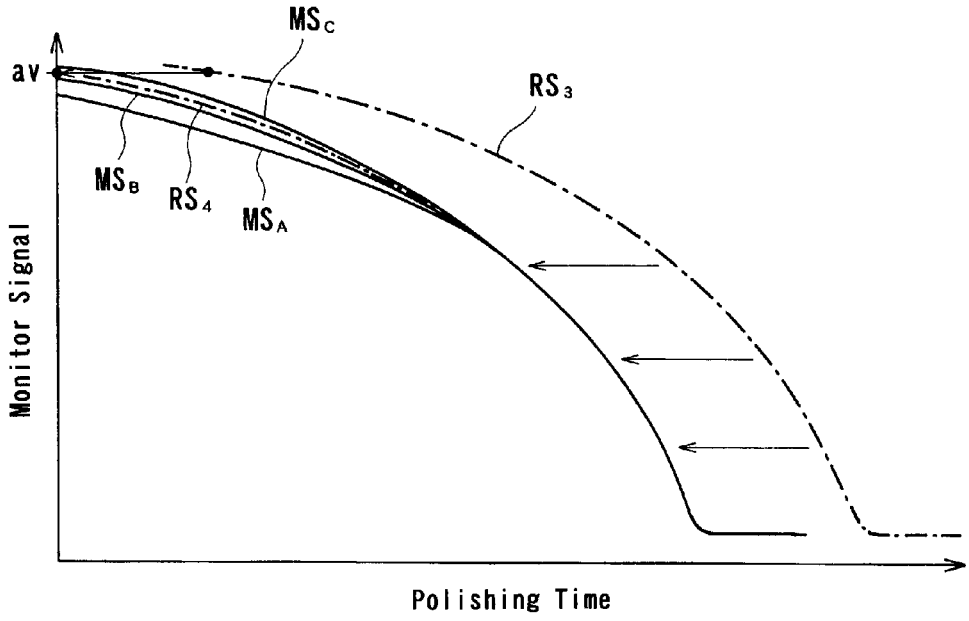
FIG. 14 is a graph showing another example of application of a reference signal according to the present invention.

FIG. 14 is a graph showing another example of application of a reference signal. In FIG. 14, a reference signal $RS_3$ is translated in parallel along a time series to generate a new reference signal $RS_4$ so that an averaged value av of monitor signal values at local points is equal to a reference signal. Any method can be employed to obtain an averaged value of monitor signal values as long as it can obtain a value representative of progress of polishing a wafer. For example, there may be employed a method of calculating an arithmetic mean or a weighted mean, a method of obtaining a median, or a method of converting monitor signal values in a certain manner and averaging the converted values.

Then, the reference signal $RS_4$ is fixed with respect to the time series. The monitor signals $MS_A$, $MS_B$, and $MS_C$ and monitor signals of unshown other points are controlled so as to converge on the reference signal $RS_4$. In this manner, it is not necessary to excessively change manipulated variables such as pressing forces applied to the areas C1-C4 of the wafer W, unlike the example shown in FIG. 13. Thus, stable polishing is expected. Further, a polishing time after the beginning of a polishing process or a control process is expected to be equal to a polishing time when a wafer having the same film thickness is polished to generate a reference signal. The within wafer uniformity can be improved irrespective of an initial film thickness profile. Simultaneously, an averaged polishing rate can be achieved irrespective of conditions of the apparatus such as a polishing pad.

Figure 15:
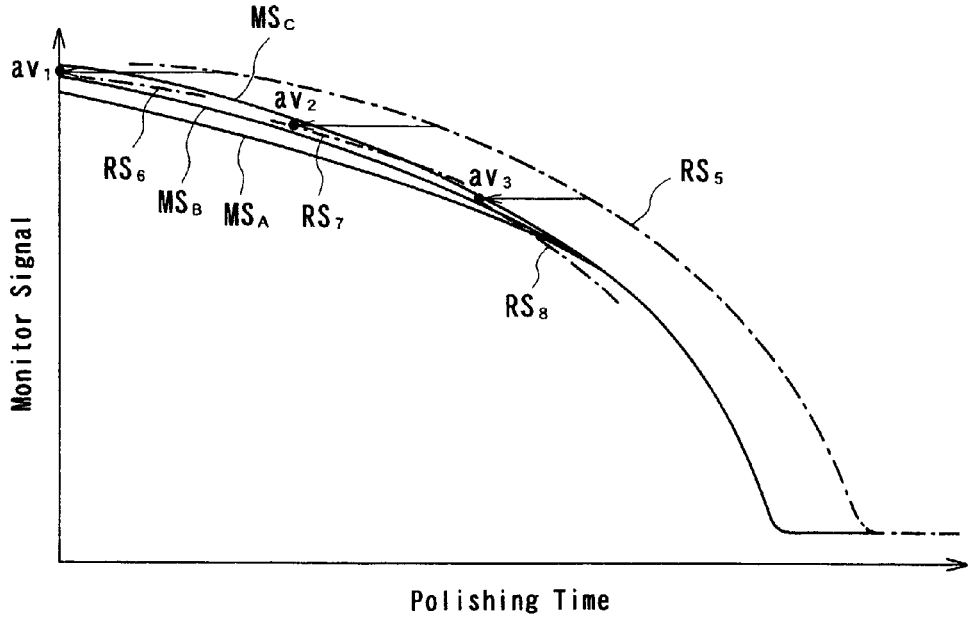
FIG. 15 is a graph showing another example of application of a reference signal according to the present invention.

FIG. 15 is a graph showing still another example of application of a reference signal. In FIG. 15, a reference signal $RS_5$ is translated in parallel along a time series in a predetermined period so that an averaged value of monitor signals at local points is equal to a reference signal. For example, the reference signal $RS_5$ is translated in parallel so as to be equal to averaged values $av_1$, $av_2$, and $av_3$ of monitor signals to thereby generate new reference signals $RS_6$, $RS_7$, and $RS_8$, respectively. Then, pressing forces applied to the areas C1-C4 of the wafer or the like are controlled so as to converge on the reference signals generated by translation from moment to moment. In this manner, in a case where initial pressing forces applied to the areas C1-C4 of the wafer are approximately within a reasonable range, if a pressing force to a certain area tends to increase at a certain point of time, a pressing force to another area tends to decrease. Accordingly, the present embodiment does not have a function to adjust a polishing time or a polishing rate but can achieve stable polishing with small variations of manipulated variables. Further, an excellent within wafer uniformity can be achieved irrespective of an initial film thickness profile.

In FIGS. 14 and 15, a reference signal is translated in parallel at the beginning of a polishing process or in a predetermined period so as to be equal to averaged values of monitor signals. However, a reference signal may be translated in parallel based on any value other than averaged values of monitor signals. For example, a reference signal may be translated in parallel based on a monitor signal of a predetermined point on a wafer. Specifically, a reference signal may be translated in parallel at the beginning of a polishing process so as to equal to a monitor signal of a predetermined point at that time. A reference signal may be translated in parallel during a polishing process so as to equal to a monitor signal of a predetermined point at that time.

Figure 16:
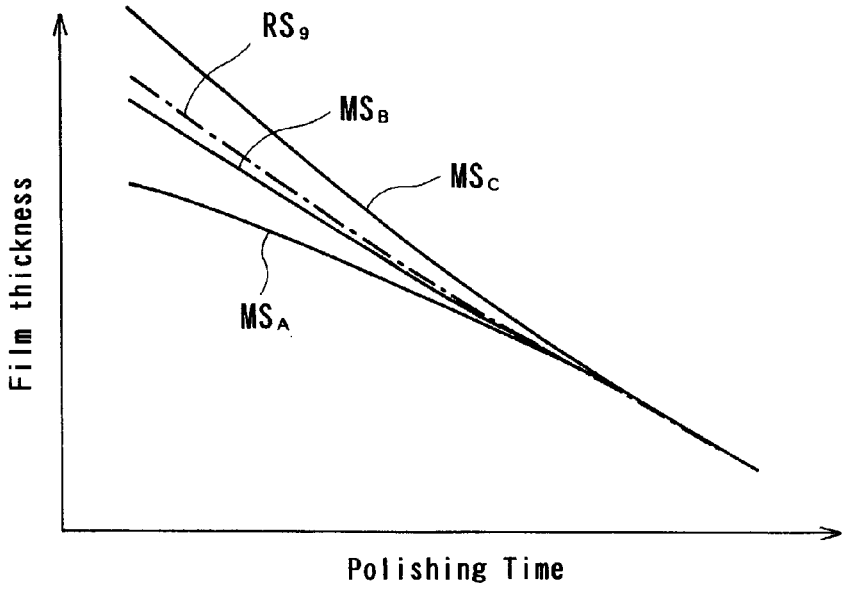
FIG. 16 is a graph showing changes of monitor signals according to a polishing method of the present invention.

In the above examples, monitor signals do not directly represent a film thickness of a surface of a wafer to be polished. As a matter of course, signals representing a film thickness of a surface of a wafer to be polished may be used as monitor signals. In such a case, time variations of monitor signals are shown in FIG. 16. In this case, monitor signals $MS_A$, $MS_B$, and $MS_C$ of local points on a wafer and monitor signals of unshown other points on the wafer are in proportion to film thicknesses at those points. As shown in FIG. 16, the monitor signal values $MS_A$, $MS_B$, $MS_C$, and the like and a reference signal $RS_9$ approximately linearly decrease according to the polishing time in general. Accordingly, it is possible to advantageously calculate predicted values after a predetermined period of time based on present signal values and gradients of time variations (differential). Thus, good controllability can readily be obtained based on linear calculation.

Figure 17:
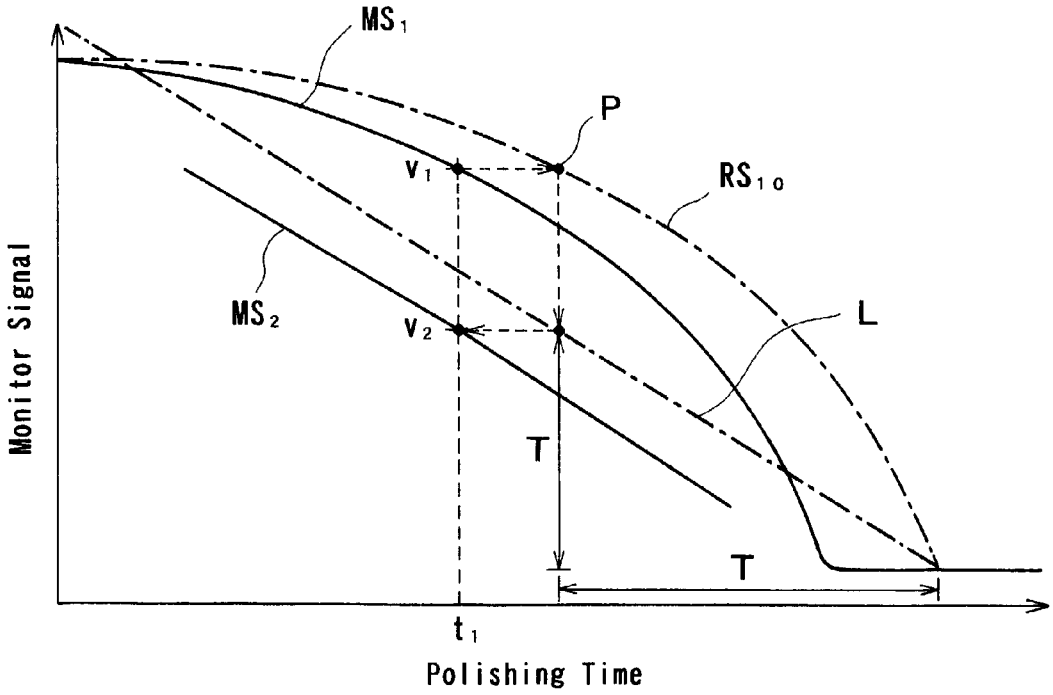
FIG. 17 is a graph showing an example of a method of converting a reference signal and a monitor signal according to the present invention.

FIG. 17 is a graph showing a method of converting a monitor signal $MS_1$ of a certain point on a wafer into a new monitor signal $MS_2$ based on a reference signal $RS_{10}$ and a straight line L. The straight line L passes through a polishing endpoint of the reference signal $RS_{10}$ and has a gradient of −1. For example, as shown in FIG. 17, when a value $v_1$ of the monitor signal $MS_1$ at time $t_1$ is provided, a point P having the same value is calculated on the reference signal $RS_{10}$. Then, a remaining time T until the polishing endpoint of the reference signal $RS_{10}$ is calculated from the time of the point P. As can be seen from FIG. 17, the remaining time T can be calculated by reference of the straight line L. A signal value $v_2$ at time $t_1$ on a new monitor signal $MS_2$ is set based on the calculated time T. For example, a signal value $v_2$ is set so that $v_2$=T. Alternatively, a signal value $v_2$ may be normalized by time $T_o$ from a polishing start to a polishing endpoint on a reference signal so that $v_2=T/T_o$. At that time, the straight line L has a value of 1 at time 0 and a gradient of $-1/T_o$.

When a similar process is applied to the reference signal $RS_{10}$, the aforementioned straight line L can be regarded as a converted new reference signal. The new reference signal (straight line L) represents a remaining time from each point to the polishing endpoint on the reference signal $RS_{10}$ and thus becomes a monotone decreasing function which is linear with respect to the time series. Thus, control arithmetic is facilitated.

Further, in most cases, a converted new monitor signal $MS_2$ is approximately in proportion to a film thickness of a surface of a wafer to be polished and thus varies linearly. Accordingly, even if a film thickness value of a surface of a wafer to be polished cannot be measured because of a polishing liquid, interconnection patterns on the surface of the wafer, an influence of an underlying layer, and the like, good control performance can be achieved by linear calculation. In the example shown in FIG. 17, the polishing endpoint on the reference signal $RS_{10}$ is used as a reference time. However, the reference time on the reference signal $RS_{10}$ is not limited to the polishing endpoint. For example, time at which the reference signal $RS_{10}$ has a predetermined value may be used as a reference time. Thus, a reference time can be set as desired. Values of a converted new monitor signal become indeterminate within an interval in which monitor signal values do not change according to a polishing time.

The above examples have been described mainly in a case where the sensor 52 comprises an eddy-current sensor. However, the sensor 52 may comprise any sensor as long as it can detect conditions of a wafer. For example, an optical sensor, a microwave sensor, or sensors based on other principles of operation may be used as the sensor 52.

Figure 18:
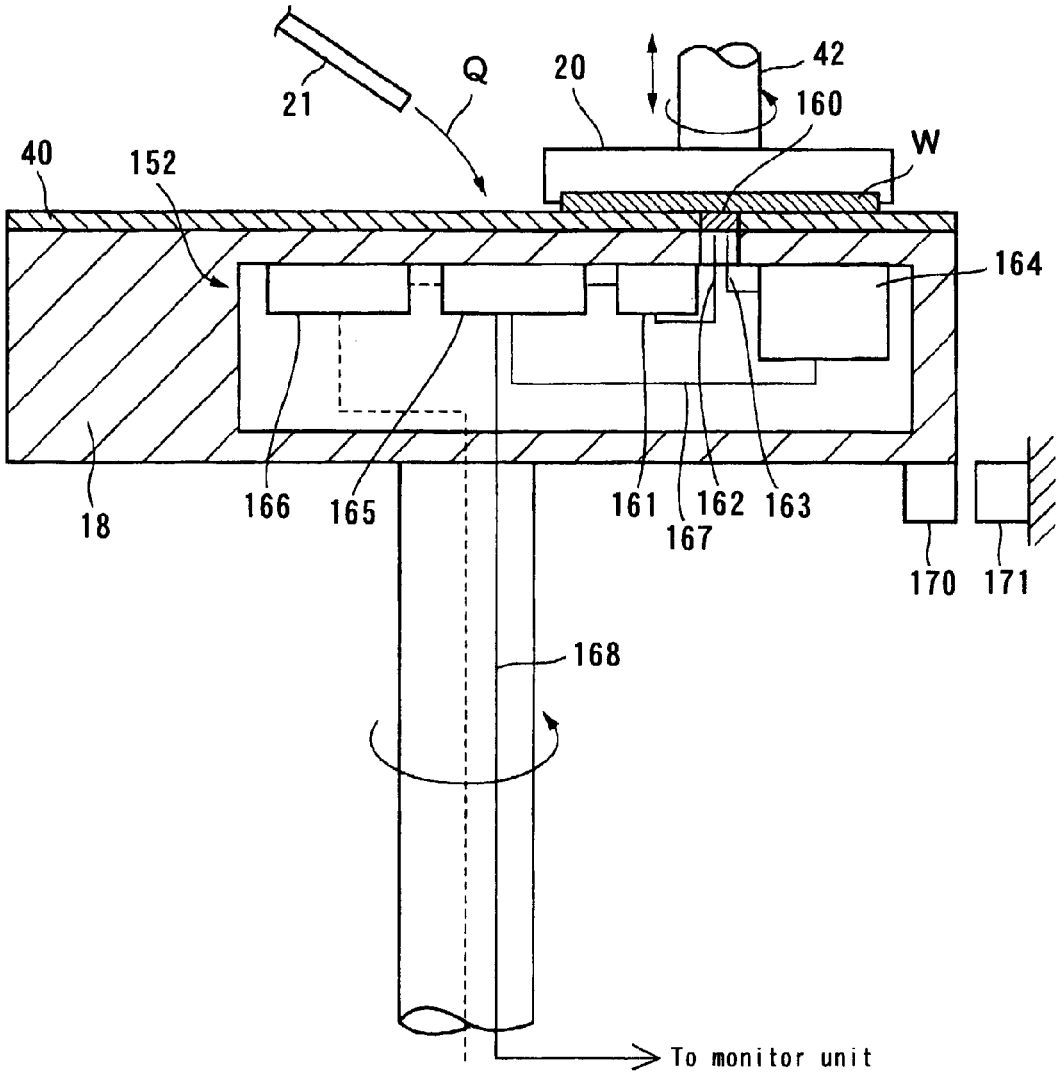
FIG. 18 is a schematic view showing a polishing unit having an optical sensor.

FIG. 18 is a schematic view showing a polishing unit having an optical sensor. As shown in FIG. 18, the polishing unit has a sensor unit 152 embedded therein for measuring characteristic values such as a film thickness or a tint of an insulating film or a metal film formed on a surface of a semiconductor wafer W to be polished so as to monitor polishing conditions during polishing. The sensor unit 152 serves to continuously monitor a polishing state (e.g., the thickness or conditions of a remaining film) of the surface of the wafer W in real time during polishing.

A light-transmissive member 160 for allowing light from the sensor unit 152 to pass therethrough is mounted in the polishing pad 40. The light-transmissive member 160 is formed of a material having a high transmittance, e.g., non-foamed polyurethane. Alternatively, a through-hole may be provided in the polishing pad 40. While the through-hole is covered with the semiconductor wafer W, a transparent liquid may be supplied from a lower portion of the through-hole so as to form the light-transmissive member 160. The light-transmissive member 160 can be disposed at any location on the polishing table 18 that passes through a surface of a semiconductor wafer W held by the top ring 20. However, it is desirable to dispose the light-transmissive member 160 at a location which passes through the center of the semiconductor wafer W as described above.

As shown in FIG. 18, the sensor unit 152 has a light source 161, a light-emitting optical fiber 162 as a light-emitting section for emitting light from the light source 161 to the surface of the semiconductor wafer W to be polished, a light-receiving optical fiber 163 as a light-receiving section for receiving reflected light from the surface to be polished, a spectroscope unit 164 including a spectroscope for dispersing the light received by the light-receiving optical fiber 163 and a plurality of light-receiving elements for storing the light dispersed by the spectroscope as electric data, a controller 165 for controlling timing of turning on and off the light source 161 or starting to read the light-receiving elements in the spectroscope unit 164, and a power source 166 for supply electric power to the controller 165. The light source 161 and the spectroscope unit 164 are supplied with electric power via the controller 165.

A light-emitting end of the light-emitting optical fiber 162 and a light-receiving end of the light-receiving optical fiber 163 are configured to be substantially perpendicular to the surface of the semiconductor wafer W to be polished. Further, the light-emitting optical fiber 162 and the light-receiving optical fiber 163 are disposed so as not to project upward from the polishing surface of the polishing table 18 in consideration of workability for replacement of the polishing pad 40 and the amount of light received by the light-receiving optical fiber 163. For example, a photodiode array with 128 elements may be used as the light-receiving elements in the spectroscope unit 164.

The spectroscope unit 164 is connected through the cable 167 to the controller 165. Information from the light-receiving elements in the spectroscope unit 164 is transmitted through the cable 167 to the controller 165, where spectrum data of the received light is produced based on the transmitted information. Specifically, in the present embodiment, the controller 165 forms a spectrum data generator for reading electric data stored in the light-receiving elements and generating spectrum data of the received light. The cable 168 extends from the controller 165 through the polishing table 18 to the aforementioned monitor unit. Thus, the spectrum data generated by the spectrum data generator in the controller 165 is transmitted through the cable 168 to the monitor unit 53 (see FIG. 2).

The monitor unit 53 calculates characteristic values, such as a film thickness or a tint, of the surface of the wafer W based on the spectrum data received from the controller 165 and provides the characteristic values as monitor signals to the aforementioned controller 53*a* (see FIG. 2).

As shown in FIG. 18, a proximity sensor 170 is mounted on a lower surface of a peripheral portion of the polishing table 18. A sensor target 171 is provided outside of the polishing table 18 so as to correspond to the proximity sensor 170. The proximity sensor 170 is operable to detect the sensor target 171 every time the polishing table 18 makes one revolution and to thus detect and a rotation angle of the polishing table 18.

Figure 19:
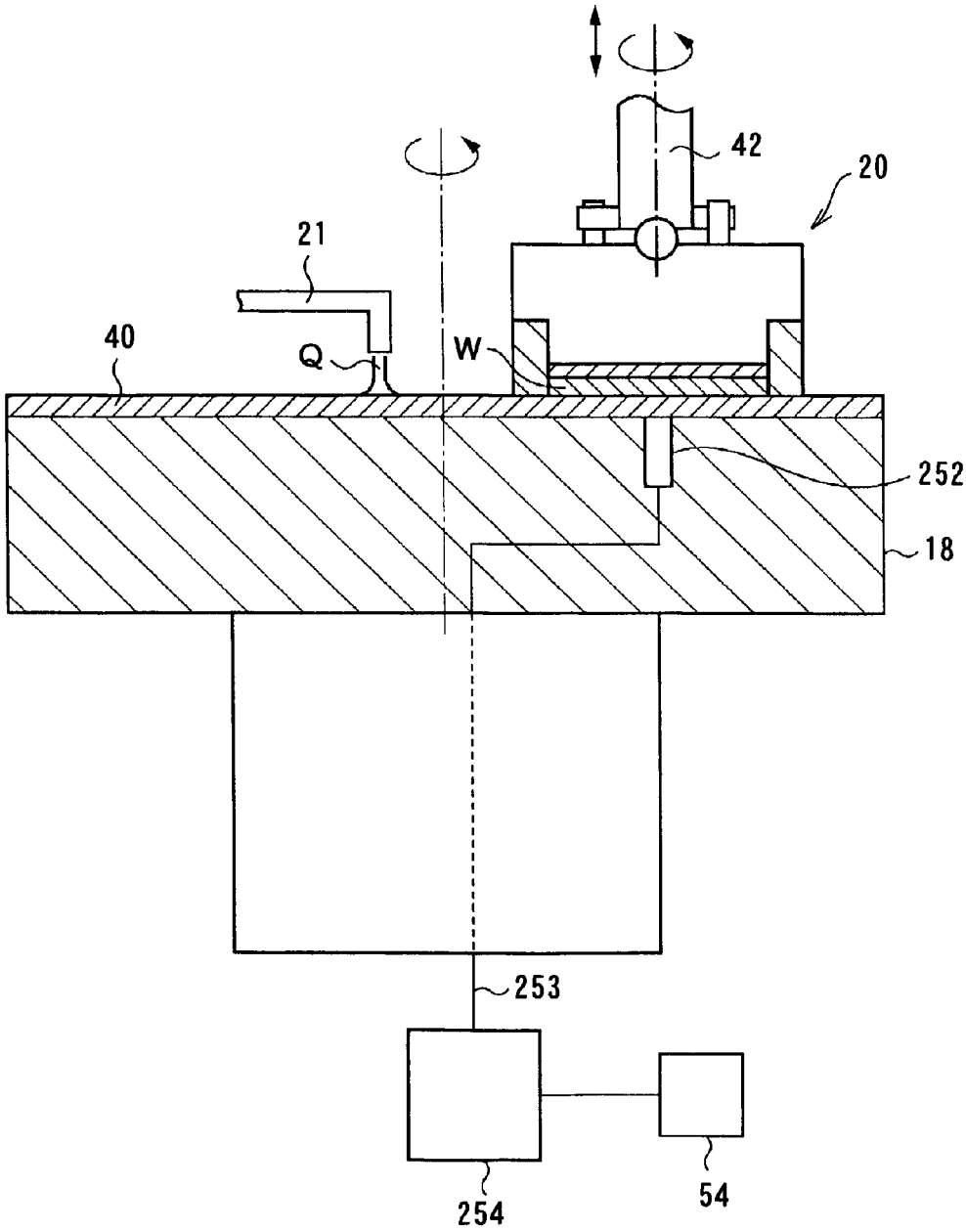
FIG. 19 is a schematic view showing a polishing unit having a microwave sensor.

FIG. 19 is a schematic view showing a polishing unit having a microwave sensor. As shown in FIG. 19, the polishing table 18 in the polishing unit has an antenna 252 embedded therein for applying a microwave to a surface of a semiconductor wafer W to be polished. The antenna 252 is disposed so as to face a central portion of the semiconductor wafer W held by the top ring 20 and connected through a waveguide 253 to the sensor body 254. It is desirable that the waveguide 253 is short in length. The antenna 252 and the sensor body 254 may be integrated with each other.

Figure 20:
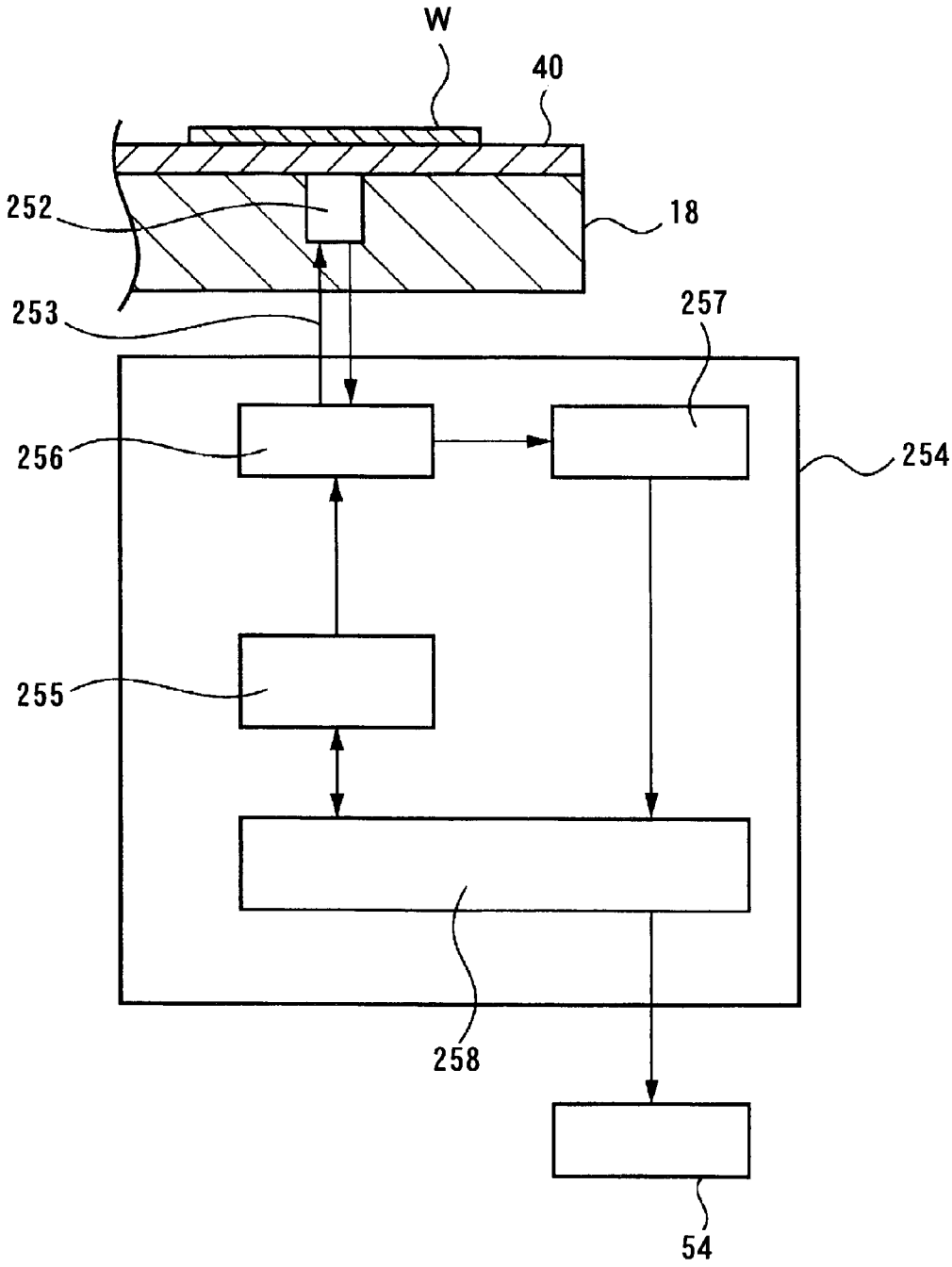
FIG. 20 is a schematic view showing the microwave sensor shown in FIG. 19.

FIG. 20 is a schematic view showing the antenna 252 and the sensor body 254 shown in FIG. 19. The sensor body 254 has a microwave source 255 for generating a microwave and supplying the microwave to the antenna 252, a separator 256 for separating a microwave (incident wave) generated by the microwave source 255 and a microwave (reflected wave) reflected from the surface of the semiconductor wafer W, a detector 257 for receiving the reflected wave separated by the separator 256 and detecting amplitude and phase of the reflected wave, and a monitor unit 258 for analyzing a structure of the semiconductor wafer W based on the amplitude and the phase of the reflected wave which are detected by the detector 257. A directional coupler may suitably be used as the separator 256.

The antenna 252 is connected through the waveguide 253 to the separator 256. The microwave source 255 is connected to the separator 256. The microwave generated by the microwave source 255 is supplied through the separator 256 and the waveguide 253 to the antenna 252. The microwave is applied from the antenna 252 to the semiconductor wafer W so as to permeate (penetrate) the polishing pad 40 and reach the semiconductor wafer W. The reflected wave from the semiconductor wafer W permeates the polishing pad 40 again and is then received by the antenna 252.

The reflected wave is sent from the antenna 252 through the waveguide 253 to the separator 256, which separates the incident wave and the reflected wave. The separator 256 is connected to the detector 257. The reflected wave separated by the separator 256 is transmitted to the detector 257. The detector 257 detects amplitude and phase of the reflected wave. Amplitude of the reflected wave is detected as a value of electric power (dbm or W) or voltage (V). Phase of the reflected wave is detected by a phase measuring device (not shown) integrated in the detector 257. Only amplitude of the reflected wave may be detected by the detector without the phase measuring device. Alternatively, only phase of the reflected wave may be detected by the phase measuring device.

In the monitor unit 258, the film thickness of a metal film or a nonmetal film deposited on the semiconductor wafer W is analyzed based on the amplitude and the phase of the reflected wave which are detected by the detector 257. The monitor unit 258 is connected to the controller 54. The value of the film thickness obtained in the monitor unit 258 is sent as a monitor signal to the controller 54.

Figure 21:
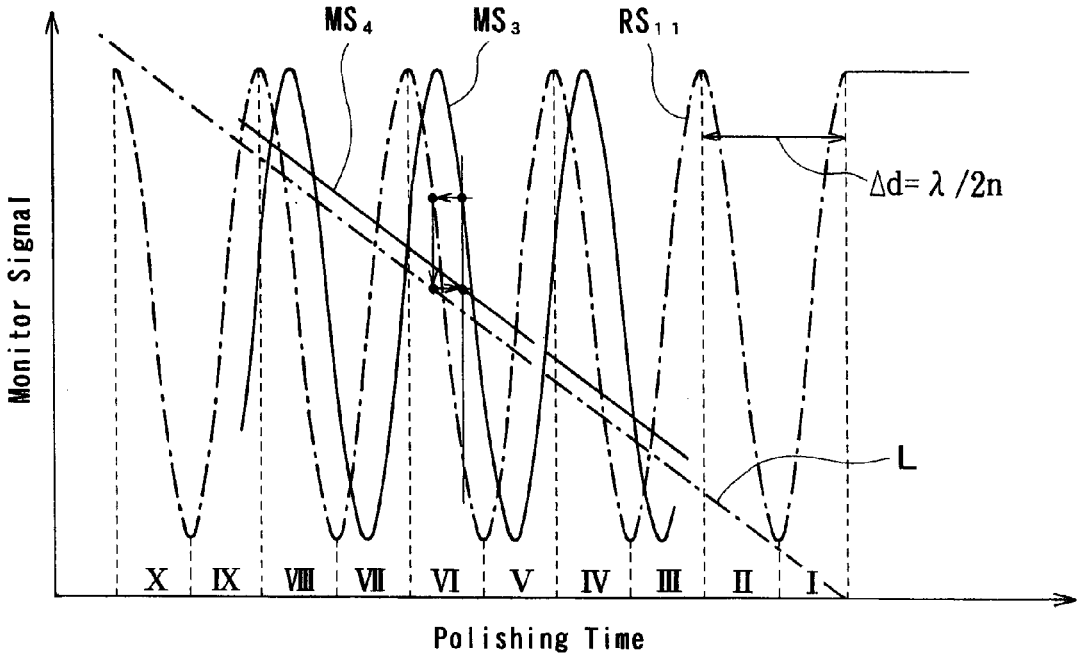
FIG. 21 is a graph explanatory of an example of application of a reference signal according to the present invention.

FIG. 21 is a graph showing changes of monitor signals when a light-transmissive film such as an oxide film is measured by using the aforementioned optical sensor. In this case, monitor signals change in the form of a sine wave with respect to a time series. Accordingly, even if a value of a monitor signal is provided, a corresponding point of a reference signal cannot uniquely be determined. However, an initial film thickness has a limited range in general. Thus, when intervals are defined in the time series of the reference signal by extremes of the signal or increases and decreases of the signal, it is possible to determine which interval corresponds to an initial film thickness. Thus, monitor signal values can correspond to the reference signal.

For example, in FIG. 21, two intervals are defined between relative maximums of a reference signal $RS_{11}$, respectively. A difference Δd between a film thickness of the film at one relative maximum and a film thickness of the film at a subsequent relative maximum is represented by $\Delta d=\lambda/2n$ where λ is the wavelength of the light and n is a refractive index of the film. If an initial film thickness is within a range between two intervals, e.g., between the interval VIII and the interval IX or between the interval IX and the interval X, it becomes possible to specify which location on the reference signal $RS_{11}$ corresponds to the initial film thickness.

After the initial film thickness is thus specified, the monitor signal $MS_3$ is controlled so as to converge on the reference signal $RS_{11}$. Thus, it is possible to control the amount of remaining film on the wafer. Further, the monitor signal $MS_3$ can be converted into a new monitor signal $MS_4$, which approximately decreases linearly, by using a straight line L in the same manner as described in connection with FIG. 17. Thus, good controllability can readily be obtained.

In an initial interval of FIG. 17 and around relative maximums and relative minimums in FIG. 21, the reference signal has a gradient near 0 and may become relatively unstable due to an influence of noise or the like. Thus, points which correspond to values of monitor signals cannot accurately be calculated on the reference signal. In such a case, it is desirable to set a new monitor signal to be indeterminate, stop the control in the interval, and continuously use the last values of manipulated variables such as pressing forces. Since the reference signal can be converted in all the intervals according to the above method, intervals in which the control is to be stopped are limited to intervals in which the new monitor signal is indeterminate and the vicinity thereof. Accordingly, even in a case where a monitor signal increases and decreases according to a polishing time as shown in FIG. 21, good control performance is expected when operation timing is properly set.

Alternatively, pressing forces applied to local points (areas) of the wafer may be determined in view of time points at which relative maximums or relative minimums appear in a monitor signal which repeats increases and decreases. Specifically, time points at which monitor signals of target points reach a relative maximum or a relative minimum are measured for each target point. Pressing forces applied to local areas corresponding to points having reach times earlier than reach times of other points are made small while pressing forces applied to local areas corresponding to points having reach times later than reach times of other points are made large. Even if monitor signals for the same film thickness vary due to an influence of patterns on a surface of a wafer, good control performance is expected. In this case, whether a time point at which a monitor signal reaches a relative maximum or a relative minimum is late or early may be judged based on a time point at which a reference signal reaches a relative maximum or a relative minimum. However, pressing forces may be adjusted without setting a reference signal based on a relative relationship of a time point at which a monitor signal of a local point reaches a relative maximum or a relative minimum. Thus, it is possible to improve a within wafer uniformity.

Figure 22:
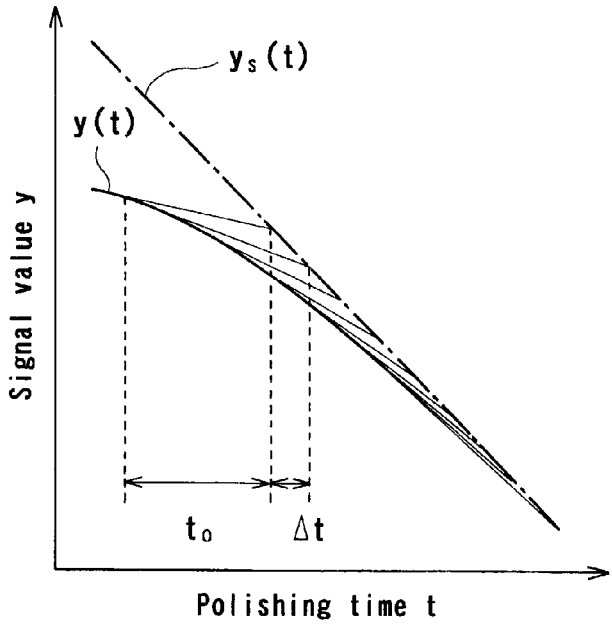
FIG. 22 is a graph explanatory of a control arithmetic method according to the present invention.

FIG. 22 is a graph explanatory of a control arithmetic method according to the present invention. A conversion method of monitor signals which has been described in connection with FIGS. 17 and 21 is applied to FIG. 22. A new reference signal $y_s(t)$ at time t after polishing start is represented by the following equation (2).

$$y_s(t)=T_0-t \tag{2}$$

In the equation (2), $T_0$ represents a period of time from the polishing start to a polishing endpoint on the reference signal.

Furthermore, $T_0$ is concerned with the reference signal which has been translated in parallel along a time series according to either one of former two of the aforementioned three methods (see FIGS. 13 and 14) in this example. Alternatively, if the reference signal has been translated in parallel along a time series according to the method as shown in FIG. 15, the right side of the equation will be an averaged value of monitor signals at local points at that time. In all the cases, at that time, a predicted value $y_p(t, t_o)$ of the monitor signal at the local point after a predetermined period of time $t_o$ has elapsed from time t is represented by the following equation (3).

$$y_p(t,t_o)=y(t)+t_o\cdot\{y(t)-y(t-\Delta t_m)\}/\Delta t_m \tag{3}$$

In the equation (3), y(t) represents a monitor signal at time t, and $\Delta t_m$ represents a predetermined period of time for calculating a gradient with respect to time variations.

At that time, a discordance $D(t, t_o)$ of the predicted value of the monitor signal after time $t_o$ has elapsed from time t to the reference signal is defined by the following equation (4).

$$D(t,t_o)=-\{y_p(t,t_o)-y_s(t+t_o)\}/t_o \tag{4}$$

When the discordance D represented by the equation (4) is positive, the monitor signal tends to lead before the reference signal. Negative discordance means that the monitor signal tends to lag behind the reference signal.

Figures 23, 24:
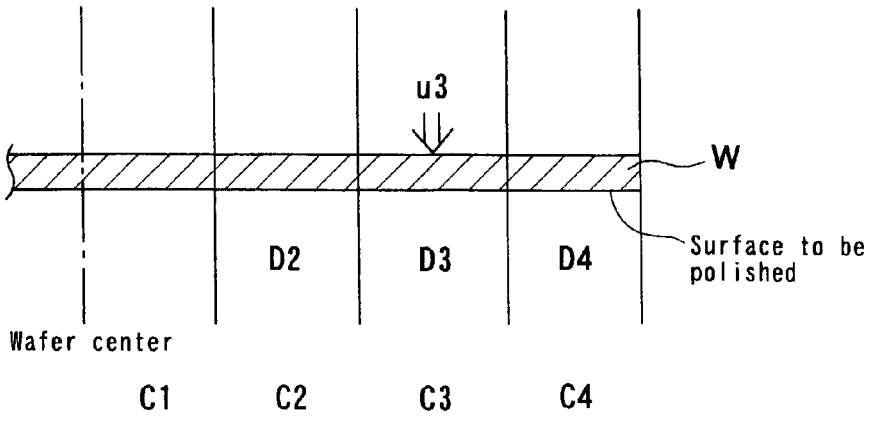
FIG. 23 is a schematic view explanatory of a predictive control according to the present invention.
FIG. 24 is a table showing an example of fuzzy rules for a predictive control according to the present invention.

As shown in FIG. 22, if predicted values of the monitor signal are always equal to the reference signal at time t of a period (cycle) Δt, then the monitor signal is expected to asymptotically converge on the reference signal. For example, as shown in FIG. 23, D3 is defined as a discordance of the area C3 of the wafer having a reverse face to which a pressing force u3 is applied, and D2 and D4 are respectively defined as discordances of the areas C2 and C4 of the wafer which are adjacent to the area C3. Variation Δu3 of the pressing force u3 is determined as follows. FIG. 24 shows an example of fuzzy rules to determine variation Δu3 of the pressing force u3. FIG. 25 shows an example of fuzzy rules in consideration of a temperature $T_p$ of a local point of the polishing pad immediate after sliding contact with the wafer, in addition to the fuzzy rules shown in FIG. 24. In FIGS. 24 and 25, "S" means low, and "B" means high. Further, "PB" means to be largely increased, "PS" means to be slightly increased, "ZR" means to be fixed, "NS" means to be slightly decreased, and "NB" means to be largely decreased.

As shown in the fuzzy rules of FIG. 24, variation Δu3 of the pressing force is made larger as the discordance D3 of the corresponding area C3 is lower or the pressing force u3 is smaller. Further, variation Δu3 is adjusted so as to be increased when the discordances D2 and D4 of the adjacent areas C2 and C4 are lower. Fuzzy rules can be determined in a similar manner for pressing forces applied to other independent areas, discordances of these areas, and variations of the pressing forces. Thus, pressing forces can be controlled without excessively large or small values so that all discordances converge on zero.

In most cases, as a polishing pad has a higher temperature, a polishing rate is increased so that the temperature of the polishing pad tends to be increased. Accordingly, in the example shown in FIG. 25, a variation Δu3 of the pressing force u3 is set larger when the temperature $T_p$ of the polishing pad is lower. A variation Δu3 of the pressing force u3 is set smaller when the temperature $T_p$ of the polishing pad is higher.

Figure 26:
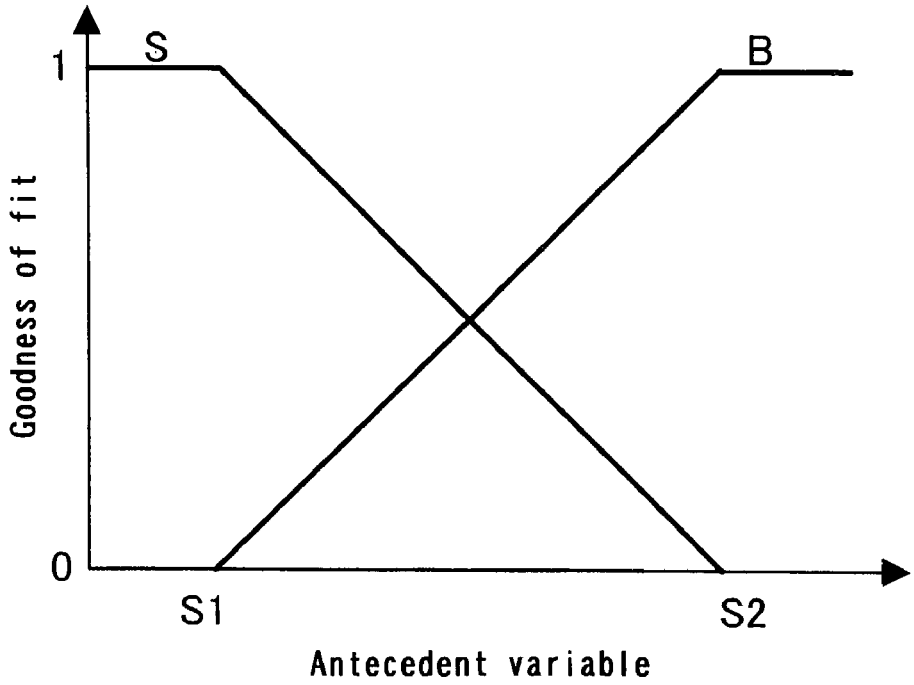
FIG. 26 is a conceptual graph showing membership functions of antecedent variables in FIGS. 24 and 25.
Figure 27:
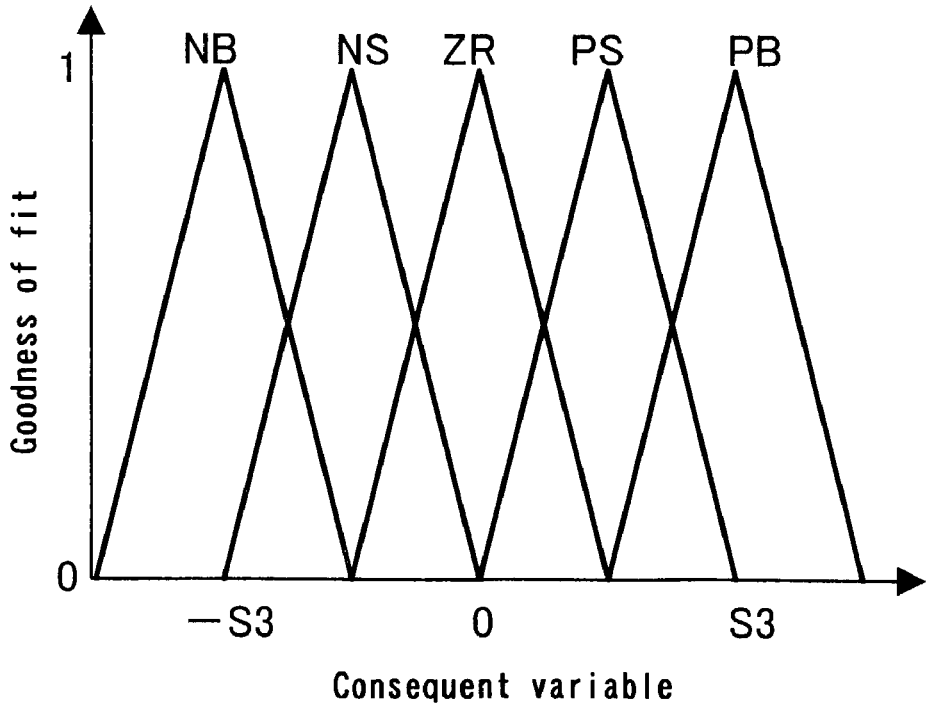
FIG. 27 is a conceptual graph showing membership functions of consequent variables in FIGS. 24 and 25.

FIG. 26 is a graph showing membership functions of antecedent variables (D2-D4, u3, $T_p$ and the like) in FIGS. 24 and 25. FIG. 27 is a graph showing membership functions of consequent variables (Δu3 and the like). By changing points S1 and S2 on an antecedent variable axis in FIG. 26, it is possible to change criteria of highness and lowness of the variables. Further, by changing coefficient S3 on a consequent variable axis in FIG. 27, it is possible to adjust sensitivity of the manipulated variable Δu3 (magnitude of the manipulated variable when antecedent variables are equal to each other).

Fuzzy rules which can be applied to the present invention are not limited to examples shown in FIGS. 24 and 25. Fuzzy rules can be defined according to properties of the system as desired. Further, membership functions of antecedent variables and consequent variables can be defined as desired. Any inference methods such as a logical multiplication method, an implication method, an aggregation method, and a defuzzification method can be selected as desired.

In the above examples, there is employed a predictive fuzzy control in which predicted values of discordances are calculated for inference. Many steps are required from the time when the sensor captures information of the surface of the wafer to the time when actual pressing forces are completely replaced with new values to change polishing conditions so that output values of the sensor are completely changed. For example, there are required many steps including transfer of the output signal from the sensor to the monitor unit, conversion into the monitor signal and smoothing the monitor signal, calculation of the pressing force, transfer to the controller 54, command to the pressure adjustment unit 45 (see FIG. 2), and operation of a pressing mechanism (pressure chambers). Accordingly, one or two seconds to about 10 seconds are required until signal waves completely reflect changes of the manipulated variables. Thus, the predictive control is effective to perform effective control with reducing an influence of response lag.

For example, a predictive model control which defines a proper mathematical model may be used as a predictive control method in addition to the aforementioned fuzzy control. When modeling is conducted including the above response lag, further improvement of control performance is expected. In such a system, when the control period is short, a subsequent operation may nonsensically be conducted before the monitor signal fully reflects changes of the manipulated variables. Further, unnecessary changes of the manipulated variables and variations of the signals may be caused. A polishing time is generally from about several tens of seconds to about several hundreds of seconds. Accordingly, if the control period is excessively long, a polishing endpoint is achieved before a desired within wafer uniformity is achieved. Therefore, it is desirable that the control period is in a range of 1 second to 10 seconds.

When a predictive model control is employed as a predictive control method, pressing forces applied to the local areas are determined as manipulated variables in the present step under the following conditions in each control period.

$$J=\|Y_R-Y_p\|^2+\lambda^2\|\Delta U_Q\|^2\rightarrow\text{minimum}$$

The first term corresponds to a difference between a reference locus $Y_R$ and a predictive response $Y_P$ from a next step to a Pth step. The second term corresponds to a variation (increment) of a manipulated variable from the present step to a Qth step. When the coefficient $\lambda^2$ in the second term is large, a weight for increment of the manipulated variable becomes large to reduce variation of the manipulated variable. On the contrary, when the coefficient $\lambda^2$ is small, variation of the manipulated variable becomes large. Specifically, $1/\lambda^2$ can be regarded as sensitivity of the manipulated variable.

Figure 28:
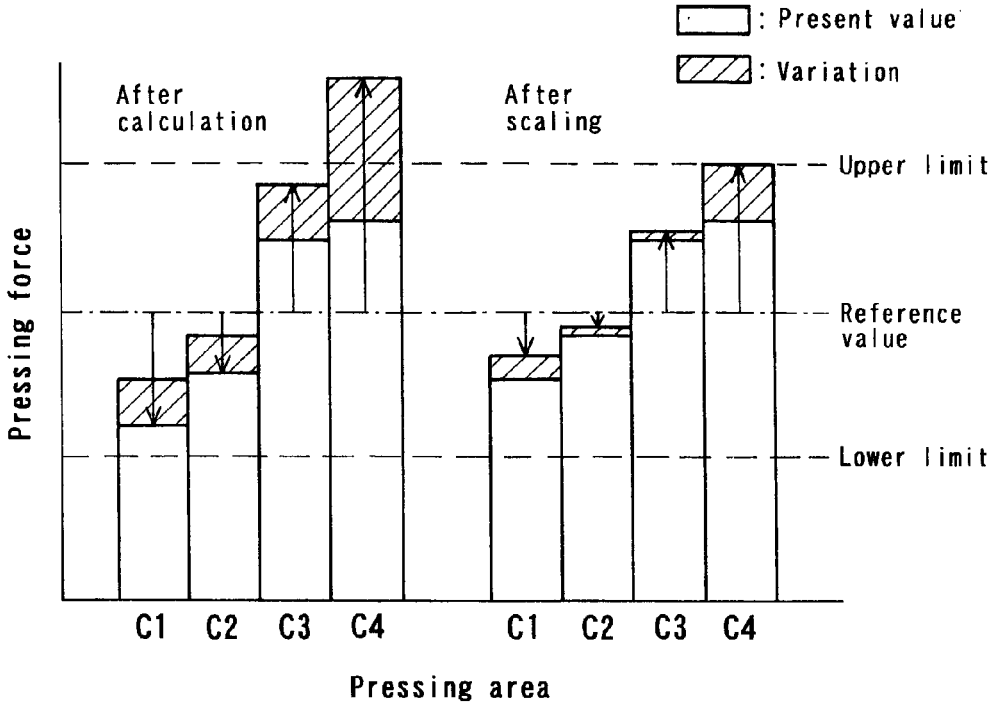
FIG. 28 is a graph explanatory of a scaling method of pressing forces according to the present invention.
Figure 29:
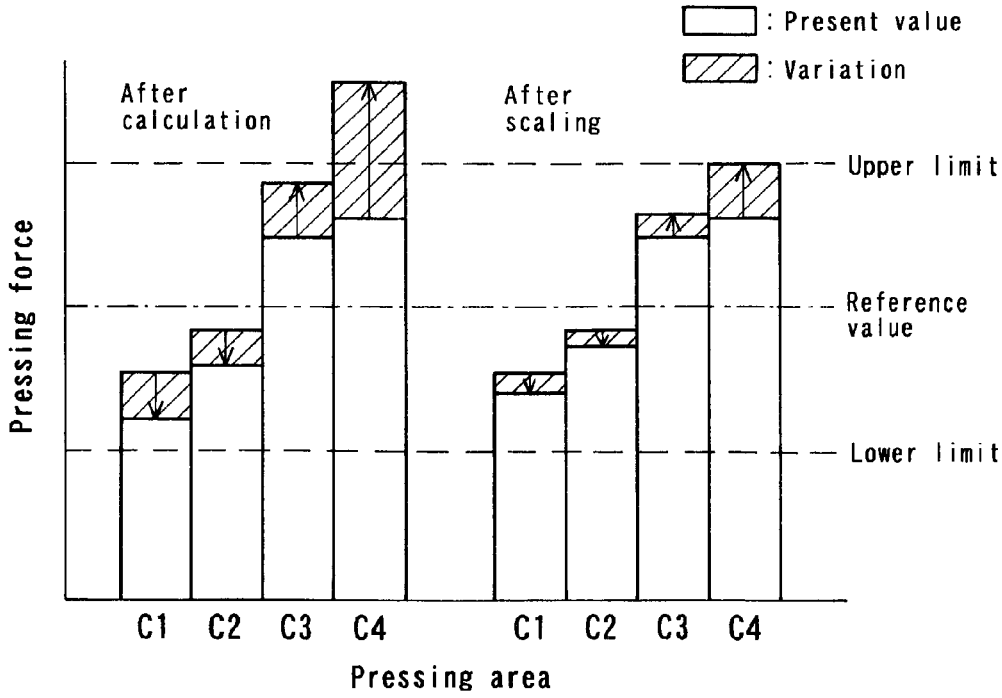
FIG. 29 is a graph explanatory of a scaling method of pressing forces according to the present invention.

FIGS. 28 and 29 are graphs explanatory of scaling conducted when variations of pressing forces at the local areas of the wafer are calculated by control arithmetic, and any one of the pressing forces (=the present values+variations) at the local areas exceeds predetermined upper and lower limits.

Since attention is attracted to the within wafer uniformity of the wafer according to control of the present invention, if a pressing force at only an area at which the pressing force exceeds the upper or lower limit is simply adjusted so as to be within a range of the upper and lower limits, balance between the areas is lost, so that good control performance cannot be expected. Accordingly, in the example shown in FIG. 28, a reference value is set for pressing forces. Variations are adjusted so that the proportion of differences at the respective areas between pressing forces (=the present values+variations) and the reference value (shown by arrows in FIG. 28) is maintained after scaling. The reference value may be an averaged value of the upper and lower limits or a predetermined standard value. Such scaling enables a distribution of pressing forces at the local areas to be substantially equal to a desired distribution calculated by control arithmetic.

In an example shown in FIG. 29, variations are adjusted in view of variations from the present pressing forces so that the proportion of variations at the respective areas (shown by arrows in FIG. 29) is maintained after scaling. Assuming that the control has been performed approximately well so far, good control can be achieved by thus scaling variations of the pressing forces. In FIGS. 28 and 29, the upper limits and the lower limits are equal in the areas C1-C4. However, the upper limits and the lower limits may be set to different values in the respective areas.

There has been described a scaling method in which upper and lower limits are set for the pressing forces in the respective areas. However, even if an upper limit is set for differences between pressing forces at adjacent areas or upper and lower limits are set for variations (increments) of pressing forces at respective areas, pressing forces can be scaled in the same manner as described above. Further, when upper and lower limits are set for variations of pressing forces, the sensitivity S3 or $1/\lambda^2$ of the manipulated variable may be adjusted to be smaller every time a control arithmetic value to the variations of pressing forces exceeds the upper or lower limit, so that the control arithmetic is repeated until the variations come into a range within the limits.

Figure 30A:
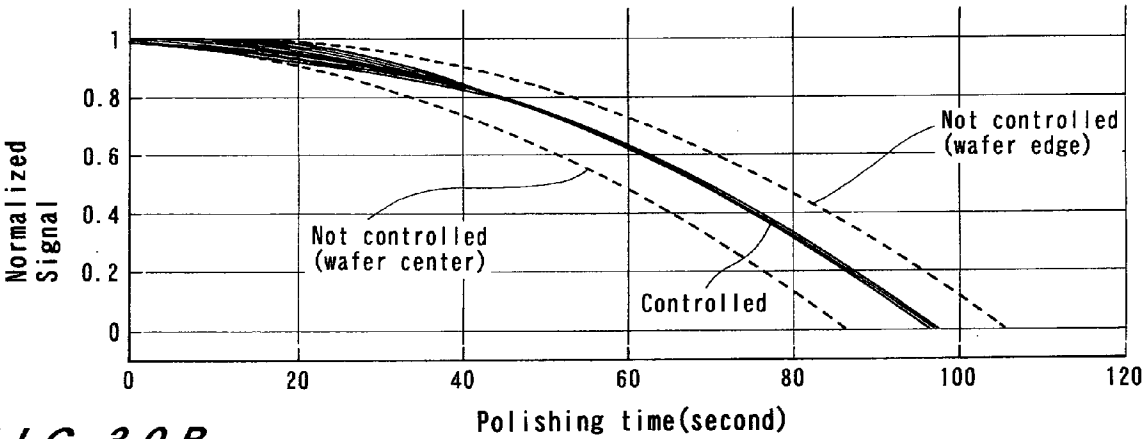
FIGS. 30A and 30B are graphs showing simulation results of a polishing method according to the present invention.
Figure 30B:
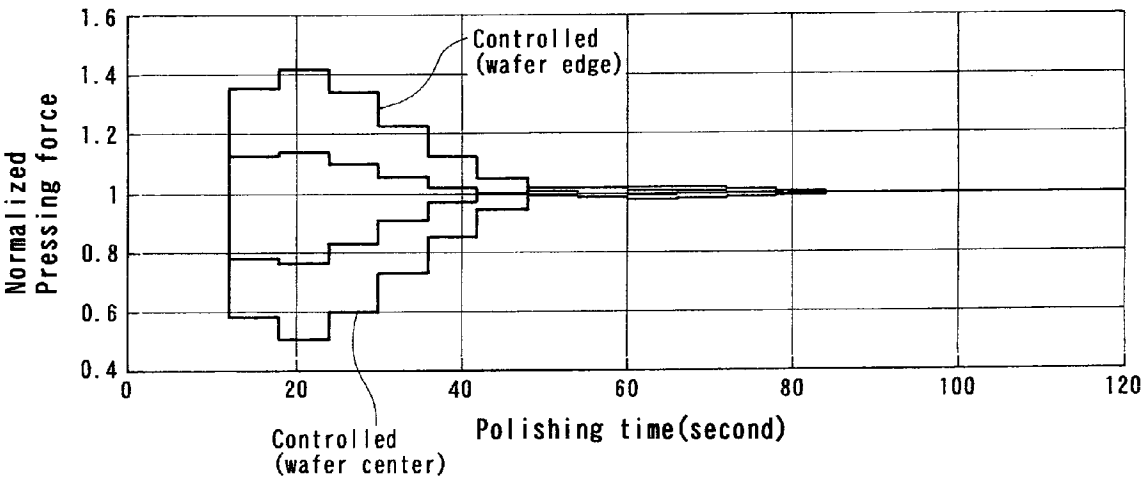

FIGS. 30A and 30B show simulation results when pressing forces of a wafer are controlled according to the aforementioned control method. In FIG. 30A, monitor signals are normalized so as to have an initial value (maximum value) of 1 and a final value (minimum value) of 0. In the example shown in FIGS. 30A and 30B, the monitor signal values of local points converge about 50 seconds after polishing start, and the pressing forces at the respective areas of the wafer approximate a constant value. Further, the pressing forces completely converge about 80 seconds after the polishing start. The monitor signals become zero to show a polishing endpoint about 95 seconds after the polishing start and then have a constant value.

Thus, when control is thus satisfactorily performed, pressing forces of local areas are expected to converge on a constant value. Accordingly, a threshold value can be provided for the monitor signals. The control is stopped using the threshold value at a predetermined time point before the polishing endpoint so that the pressing forces of the respective areas are maintained. Thus, stable polishing is guaranteed without changes of the pressing forces near the polishing endpoint, and problems such as dishing can be eliminated.

Further, values of the pressing forces at the respective areas are stored in a storage device after polishing. The stored values of the pressing force can be used when a wafer having the same specification is polished. Thus, normal pressing forces can be applied during initial polishing, and unnecessary variations of pressing forces can be prevented during polishing. Particularly, when a wafer has a high within wafer uniformity before polishing, remarkably stable polishing can be achieved while the pressing forces are hardly varied during polishing.

Alternatively, when the within wafer uniformity is initially high, properties of such control can be used to determine initial polishing conditions. Conventionally, a process engineer repeats polishing of wafers and measurement of film thickness distributions with a stand-alone measuring device, determines polishing conditions such as pressing forces applied to local areas of the wafers or a retainer ring by trial and error, and produces a recipe. Accordingly, many processes are required, and a large number of wafers are also required for trial. When a polishing method according to the present invention is applied to such process initialization, polishing conditions can immediately be determined even if the polishing conditions such as pressing forces cannot be changed dynamically during polishing product wafers in view of safety. Thus, loads on the process engineer can be reduced, and wafers for trial can be saved.

When product wafers are polished, monitor signals may be generated based on sensing signals obtained by the same sensor as described above, so that an endpoint can be detected based on the monitor signals. The monitor signals may comprise monitor signals used in the aforementioned control or may be generated by other conversion methods. As in the example shown in FIG. 30A, the monitor signals of the respective areas have substantially the same value near the polishing endpoint, and the within wafer uniformity is high near the polishing endpoint. Accordingly, even if an overpolishing time is short, no polishing residue of a metal film is guaranteed. Thus, it is possible to avoid problems such as dishing or erosion caused by overpolishing. Similarly, in a case of a light-transmissive interlayer dielectric, while the within wafer uniformity is improved, the polishing process can be stopped accurately at a predetermined film thickness. Further, since new hardware is not required, the present invention is economical.

Figure 31:
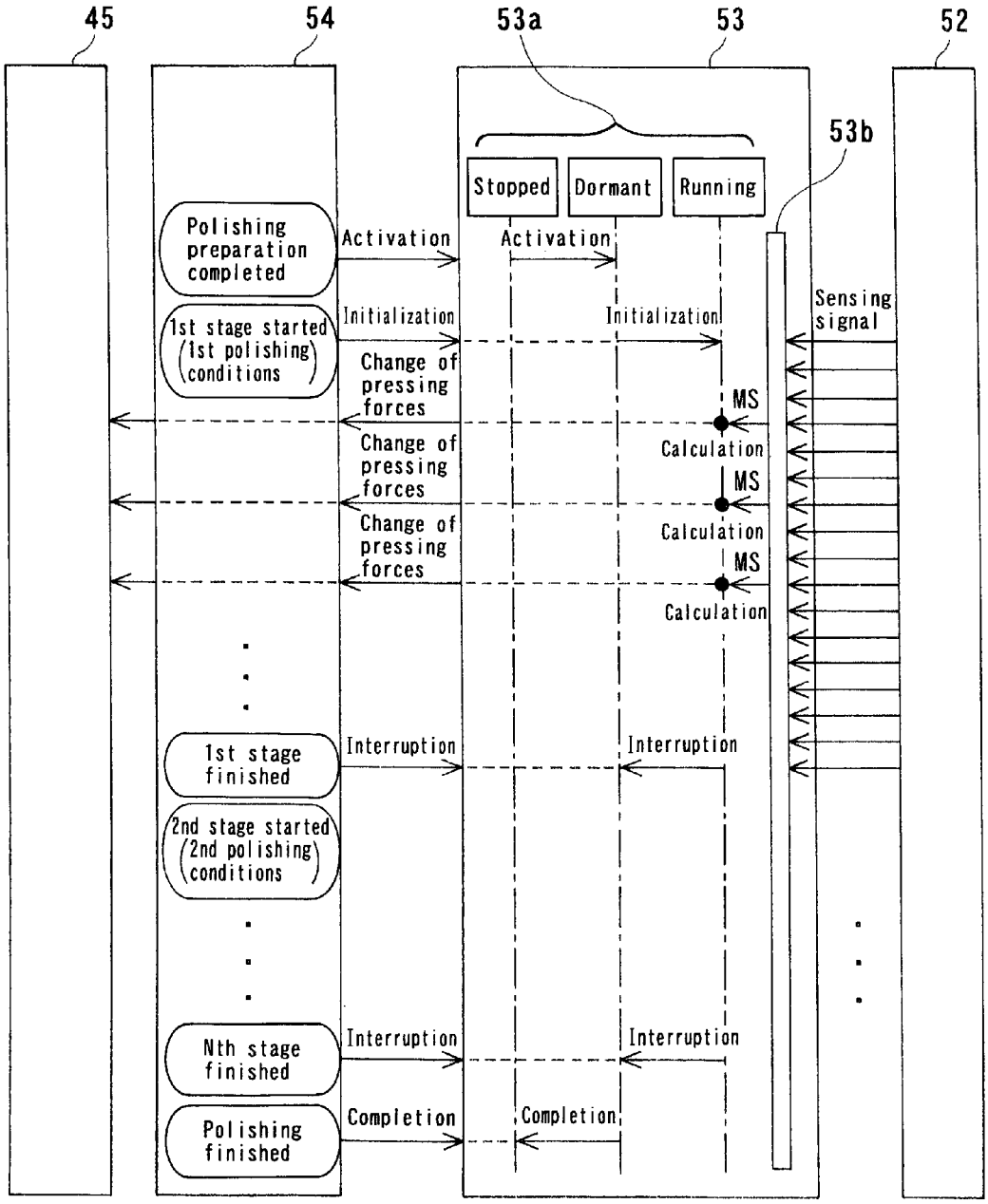
FIG. 31 is a schematic view showing an example in which a polishing method according to the present invention is applied to a polishing process having a plurality of stages.

A polishing method according to the present invention is applicable to a polishing process including a plurality of stages. FIG. 31 is a block diagram showing a system flow in which one wafer is subjected to a polishing process including N stages. Operations other than polishing operation, such as dressing of a polishing surface, may be included in each stage. Further, polishing conditions (rotational speeds of a polishing table and a top ring, a polishing liquid, a pressing force by the top ring, and the like) may be set independently in the respective stages. Further, a polishing method according to the present invention can be applied to all stages in the polishing process. Alternatively, a polishing method according to the present invention may be applied to only necessary stages.

The controller 53*a* in the monitor unit 53 is usually in a stopped state. When polishing preparation is completed after a wafer to be polished is loaded into the top ring and moved to above the polishing table, the controller 54 issues an activation command so that the controller 53*a* reads necessary information, such as control parameters or reference signals of the wafer, from the storage device such as a hard disk and shifts the stopped state into a dormant state.

When a first stage of polishing is started, the controller 54 sends an initialization command to the monitor unit 53. The controller 53*a* delivers information necessary for the first stage of polishing to an arithmetic routine, initializes a memory in the arithmetic routine, and shifts the dormant state into a running state.

Then, the arithmetic routine is operated at predetermined timing in the controller 53*a* of the monitor unit 53 so as to perform an arithmetic process on a monitor signal MS, which is generated based on an output signal of the sensor by a monitoring section 53*b*, to thereby calculate a pressing force of the wafer or the like. The calculated pressing force is transmitted via the controller 54 to the pressure adjustment unit 45, which adjusts pressing forces of the top ring. Then, when the first stage of polishing is finished, the controller 54 sends an interruption command to the monitor unit 53, and the controller 53*a* shifts the running state into the dormant state. As described above, not only monitoring or calculation for endpoint detection but also control arithmetic is performed in the monitor unit 53. Accordingly, a system in which the amount of data transfer to the CMP apparatus is small can be configured without adding any hardware.

Then, at respective stages to which a polishing method according to the present invention is applied, similar processes from a running state to a dormant state are repeated. When the last stage of polishing is finished, the controller 54 sends a completion command to the monitor unit 53, and the controller 53*a* shifts the dormant state into the stopped state. In the above examples, pressing forces of the top ring are controlled. Pressing forces of the retainer ring may be controlled in addition to pressing forces of the top ring.

An example of a polishing apparatus has been described in the above embodiment. However, the present invention is applicable to other substrate processing apparatuses. For example, the present invention can be applied to a plating apparatus or a chemical vapor deposition (CVD) apparatus.

Figure 32:
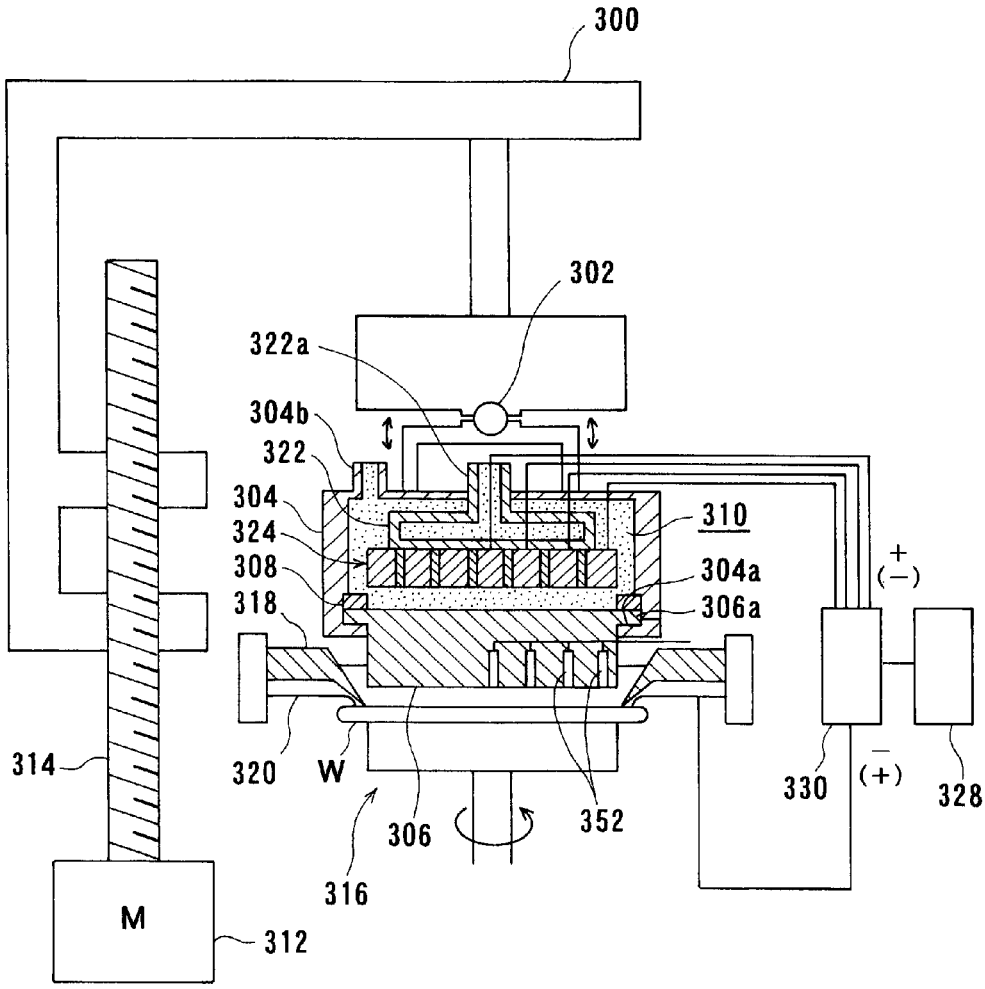
FIG. 32 is a vertical cross-sectional view showing an example of a plating apparatus to which the present invention is applicable.
Figure 33:
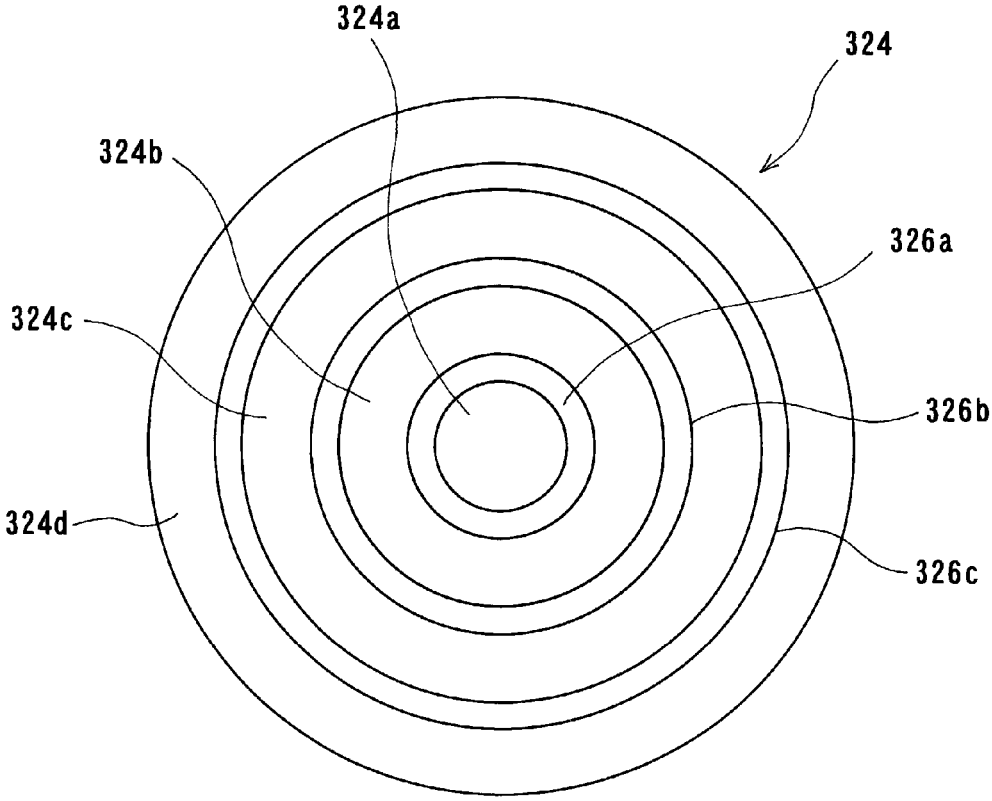
FIG. 33 is a plan view of an anode in the plating apparatus shown in FIG. 32.

FIG. 32 is a cross-sectional view showing an example of a plating apparatus to which the present invention is applicable, and FIG. 33 is a plan view showing an anode in the plating apparatus shown in FIG. 32. As shown in FIGS. 32 and 33, the plating apparatus has a swing arm 300, a housing 304 connected via a ball bearing 302 to a free end of the swing arm 300, and an impregnation member 306 disposed so as to cover an opening at a lower end of the housing 304. The impregnation member 306 is formed of a material having water retentivity.

The housing 304 has an inward projecting portion 304*a* located at a lower portion of the housing 304. The impregnation member 306 has a flange portion 306*a* located at an upper portion of the impregnation member 306. The flange portion 306*a* of the impregnation member 306 is engaged with the inward projecting portion 304*a* of the housing 304 while a spacer 308 is located on an upper surface of the flange portion 306*a*. In this manner, the impregnation member 306 is held in the housing 304. Thus, a plating solution chamber 310 is formed in the housing 304.

The swing arm 300 is configured to be vertically movable via a vertical movement motor 312, which comprises a servomotor, and a ball screw 314. Such vertical movement mechanism may comprise a pneumatic actuator. A wafer W is held by a wafer holder 316 so that a seal member 318 and cathode electrodes 320 are brought into contact with a peripheral portion of the wafer W.

The impregnation member 306 is formed of porous ceramics such as alumina, SiC, mullite, zirconia, titania, or cordierite, a hard porous member such as a sintered compact of polypropylene or polyethylene, or a complex of these materials, woven fabric, or non-woven fabric. For example, alumina ceramics having a pore diameter of 30 to 200 μm or SiC having a pore diameter of 30 μm or less is preferably employed. It is desirable that the impregnation member 306 has a porosity of 20 to 95%, a thickness of about 1 to about 20 mm, preferably about 5 to about 20 mm, more preferably about 8 to about 15 mm. For example, the impregnation member 306 is formed by a porous ceramic plate made of alumina having a porosity of 30% and an average pore diameter of 100 μm. The impregnation member 306 is impregnated with a plating solution so as to have an electric conductivity lower than the electric conductivity of the plating solution. Specifically, although a porous ceramic plate is an insulating member per se, a plating solution is introduced complicatedly into the porous ceramic plate so as to have considerably long paths in a thickness direction. Thus, the impregnation member 306 is configured to have an electric conductivity lower than the electric conductivity of the plating solution.

Thus, the impregnation member 306 is disposed in the plating solution chamber 310 so that a high resistance is provided by the impregnation member 306. A sheet resistance of a surface of a wafer such as a seed layer is reduced to a negligible degree so that a difference of the current density on the wafer which is caused by the sheet resistance of the surface of the wafer is reduced to improve a within wafer uniformity of a plated film.

A plating solution introduction pipe 322 is disposed in the plating solution chamber 310, and an anode 324 is attached to a lower surface of the plating solution introduction pipe 322. The plating solution introduction pipe 322 has a plating solution introduction port 322*a* connected to a plating solution supply source (not shown). The housing 304 has a plating solution discharge port 304*b* provided on an upper surface of the housing 304.

The plating solution introduction pipe 322 has a manifold structure so as to supply a plating solution uniformly to a surface to be plated. Specifically, a large number of tubules (not shown) are connected to predetermined locations in a longitudinal direction so as to communicate with the interior of the plating solution introduction pipe 322. The anode 324 and the impregnation member 306 have fine holes formed at locations corresponding to the tubules. The tubules extend downward through the fine holes to a lower surface of the impregnation member 306 or its vicinity.

A plating solution introduced from the plating solution introduction pipe 322 passes through the tubules and reaches the lower portion of the impregnation member 306. Thus, the plating solution passes through the interior of the impregnation member 306. Further, the plating solution chamber 310 is filled with the plating solution so as to immerse the anode 324 in the plating solution. Furthermore, the plating solution can be drawn through the plating solution discharge port 304*b*. The anode 324 may include a large number of through-holes vertically penetrating the anode 324 so that the plating solution introduced into the plating solution chamber 310 flows through the through-holes into the impregnation member 306.

The anode 324 is generally made of copper containing from 0.03% to 0.05% phosphorus for the purpose of preventing generation of slime. In this embodiment, for example, an insoluble anode which includes an insoluble electrode having metal plated with platinum or the like or insoluble metal such as platinum or titanium is employed as the anode 324. Since an insoluble anode is employed as the anode 324, the anode 324 is prevented from changing its shape due to dissolution. Accordingly, a constant discharge state can continuously be maintained without replacement of the anode 324.

As shown in FIG. 33, the anode 324 includes four anodes 324*a* to 324*d* divided concentrically in this example. Annular insulating members 326*a* to 326*c* are interposed between adjacent divided surfaces of the divided anodes 324*a* to 324*d*. Specifically, the anode 324 includes a first divided anode 324*a* in the form of a solid circular plate located at a central area of the anode 324, an annular second divided anode 324*b* surrounding the first divided anode 324*a*, an annular third divided anode 324*c* surrounding the second divided anode 324*b*, and a fourth divided anode 324*d* surrounding the third divided anode 324*c*. Annular insulating members 326*a* to 326*c* are interposed between the first divided anode 324*a* and the second divided anode 324*b*, between the second divided anode 324*b* and the third divided anode 324*c*, and between the third divided anode 324*c* and the fourth divided anode 324*d*, respectively. The divided anodes 324*a* to 324*d* and the annular insulating members 326*a* to 326*c* are disposed on the same plane.

As shown in FIG. 32, the cathode electrodes 320 are electrically connected to an anode of the plating power source 328, and the anode 324 is electrically connected to a cathode of the plating power source 328. A rectifier 330 is connected to the plating power source 328. The rectifier 330 can change directions of flowing current as desired and adjust individual voltages or currents supplied between the first divided anode 324*a* and the surface of the wafer to be plated, between the second divided anode 324*b* and the surface of the wafer to be plated, between the third divided anode 324*c* and the surface of the wafer to be plated, and between the fourth divided anode 324*d* and the surface of the wafer to be plated, as desired.

For example, the current density is adjusted during an initial plating process so that a central portion of the anode 324 has a current density higher than a current density of a peripheral portion of the anode 324 (the fourth divided anode 324*d*<the third divided anode 324*c*<the second divided anode 324*b*<the first divided anode 324*a*). Thus, a plating current also flows through the central portion of the wafer W. Further, a high resistance is produced in the impregnation member 306, which holds the plating solution therein, so that a sheet resistance of a surface of a wafer is reduced to a negligible degree. Even if a wafer has a higher sheet resistance, these effects cooperatively reduce a difference of the current density on the wafer which is caused by the sheet resistance of the surface of the wafer. Thus, a plated film having uniform thickness can be reliably formed.

As shown in FIG. 32, the impregnation member 306 includes sensors 352 disposed at locations corresponding to the divided anodes 324*a* to 324*d* for measuring the film thickness on the surface of the wafer. Various sensors including an eddy-current sensor or an optical sensor can be used as the sensors 352. The film thickness on the surface of the wafer is measured by the sensors 352. Voltages applied to the divided anodes 324*a* to 324*d* are controlled so that the film thickness converges on the aforementioned reference signal.

Figure 34:
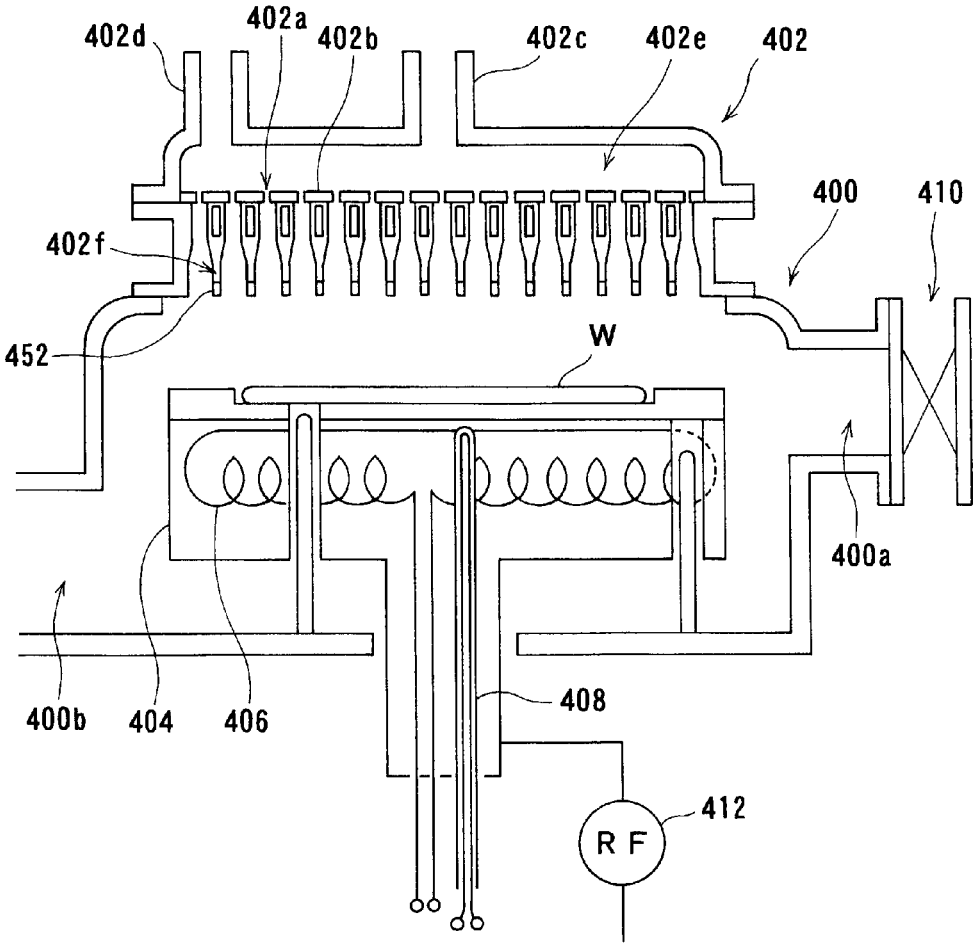
FIG. 34 is a vertical cross-sectional view showing an example of a CVD apparatus to which the present invention is applicable.

FIG. 34 is a vertical cross-sectional view showing an example of a CVD apparatus to which the present invention is applicable. As shown in FIG. 34, the CVD apparatus has a deposition chamber 400, a gas ejection head 402 disposed at an upper portion of the deposition chamber 400, and a hot plate 404 disposed within the deposition chamber 400. The hot plate 404 houses therein a heater 406 and a temperature sensor 408 for measuring the temperature of a portion right below a wafer placement portion.

The deposition chamber 400 includes a transfer port 400*a* for transferring a wafer W into the deposition chamber 400 and transferring the wafer W from the deposition chamber 400, and a discharge port 400*b* for discharging air from the interior of the deposition chamber 400. The transfer port 400*a* has a gate 410 so as to maintain the interior of the deposition chamber 400 at a low pressure of 13.33 Pa (0.1 Torr) or less via the discharge port 400*b*.

The gas ejection head 402 has a plate-like nozzle plate 402*b* including a large number of gas ejection holes 402*a*, a gas introduction port 402*c* for introducing a process gas such as a raw gas or radicals, and a gas discharge port 402*d* for replacement of the gas.

A high-frequency voltage (e.g., 13.5 MHz or 60 MHz) may be applied between the hot plate 404 and the gas ejection head 402 by a high-frequency power source 412. Thus, plasma may be generated in a space between the hot plate 404 and the gas ejection head 402 and utilized for cleaning attached matter.

In the gas ejection head 402 thus constructed, the process gas introduced into a head chamber 402*e* is ejected toward the wafer W from a large number of gas ejection holes 402*a* in the nozzle plate 402*b*. Diffuser members 402*f* for rectifying a flow of the process gas ejected from the gas ejection holes 402*a* and decelerating the flow are mounted on a lower surface of the nozzle plate 402*b*. Each of the diffuser members 402*f* has a sufficiently long length so that the process gas ejected from the gas ejection holes 402*a* becomes an uniform flow immediately after leaving the diffuser members 402*f* and reaches the surface of the wafer W. The diffuser members 402*f* are coupled to an actuator (not shown) to adjust the angles of the diffuser members 402*f* as desired.

Sensors 452 for measuring the film thickness on the surface of the wafer are attached to tip ends of the diffuser members 402*f*. These sensors 452 may comprise various sensors including an eddy-current sensor and an optical sensor. The film thickness on the surface of the wafer is measured by the sensors 452. The angles of the respective diffuser members 402*f* and the flow rate of the process gas are controlled so that the film thickness converges on the aforementioned reference signal.

Figure 35:
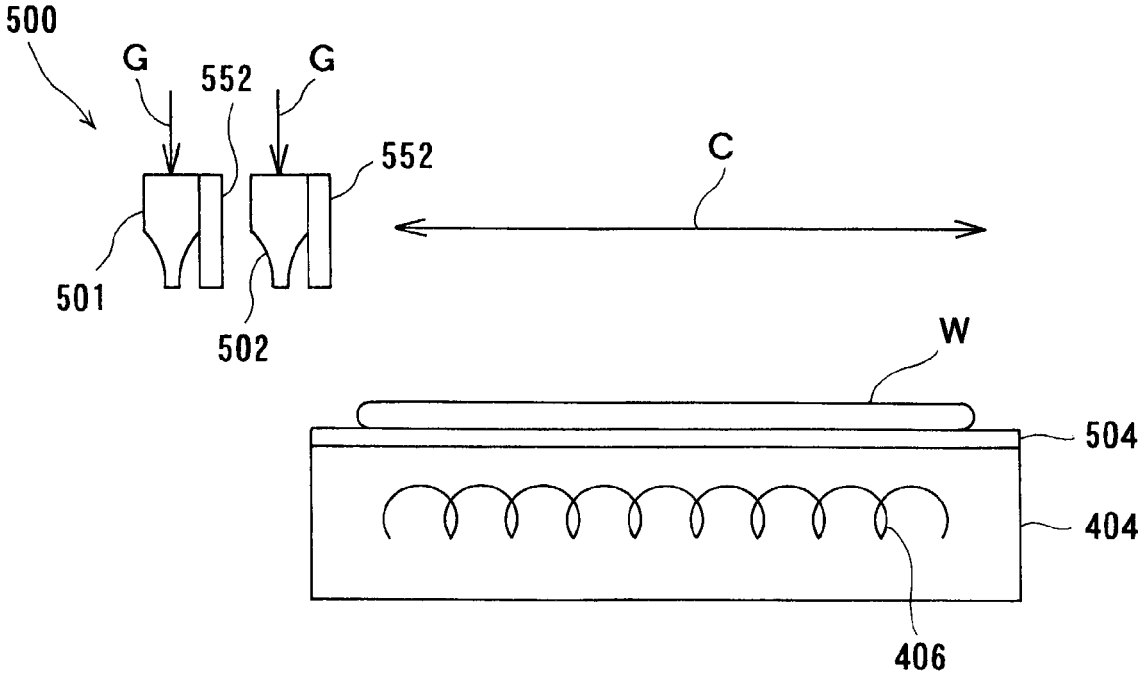
FIG. 35 is a vertical cross-sectional view showing another example of a CVD apparatus to which the present invention is applicable.

FIG. 35 is a vertical cross-sectional view showing a gas ejection head 500 in a CVD apparatus to which the present invention is applicable. As shown in FIG. 35, the gas ejection head 500 has two gas ejection nozzle bodies 501 and 502. The two gas ejection nozzle bodies 501 and 502 are reciprocated above one wafer W placed on a susceptor 504, which is disposed in a deposition chamber (not shown), as shown by arrow C. Each of the gas ejection nozzle bodies 501 and 502 has a large number of gas ejection holes formed on a bottom thereof. Predetermined process gases G are supplied to the gas ejection nozzle bodies 501 and 502 to eject the process gases to the surface of the wafer W from the gas ejection holes.

The interior of the deposition chamber is maintained at a low pressure (e.g., 13.33 Pa (0.1 Torr) or less). Hydrogen or hydrogen radicals are supplied to the gas ejection nozzle body 501, and a gas for Cu organic metal material is supplied to the gas ejection nozzle body 502. The two gas ejection nozzle bodies 501 and 502 are integrally reciprocated or are reciprocated at varied speeds. Further, supplied gases are switched when a first half reciprocating movement is completed. Specifically, a gas for Cu organic metal material is supplied to the gas ejection nozzle body 501, and hydrogen or hydrogen radicals are supplied to the gas ejection nozzle body 502. Then, a second half reciprocating movement is started. These operations are repeated (or may be performed only once). Thus, a Cu thin film is formed on the upper surface of the wafer W.

Sensors 552 for measuring the film thickness on the surface of the wafer are attached to the gas ejection nozzle bodies 501 and 502. These sensors 552 may comprise various sensors including an eddy-current sensor and an optical sensor. Both of the gas ejection nozzle bodies 501 and 502 may not have sensors, and either one of the gas ejection nozzle bodies 501 and 502 may have a sensor. When the gas ejection nozzle bodies 501 and 502 are reciprocated on the wafer, film thickness information can be obtained in a radial direction of the wafer W. The amounts of gases G to be supplied from the gas ejection nozzle bodies 501 and 502 are controlled so that the film thickness converges on the aforementioned reference signal. For example, when a uniform film thickness is to be achieved over the entire surface of the wafer W based on the reference signal, the flow rate of gases are controlled in synchronism with the reciprocating movement of the gas ejection nozzle bodies 501 and 502.

Although certain preferred embodiments of the present invention have been described in detail, the present invention is not limited to the above embodiments. It should be understood that various changes and modifications may be made therein without departing from the scope of the present invention.

INDUSTRIAL APPLICABILITY

The present invention is suitable for use in a polishing apparatus for polishing and planarizing a substrate such as a semiconductor wafer.

The invention claimed is:

1. A polishing apparatus comprising:

a polishing table for supporting a polishing surface;

a top ring for pressing a substrate against said polishing surface while controlling a pressing force applied to at least one area on the substrate;

a sensor for monitoring a substrate condition of at least one measurement point on the substrate during polishing;

a monitor unit for performing a predetermined arithmetic process on a signal from said sensor to generate a monitor signal;

a storage device for storing a reference signal representing a relationship between a reference value for the monitor signal and time; and a controller for predicting a predicted value of the monitor signal and comparing the predicted value of the monitor signal of the measurement point with the reference signal and controlling the pressing force applied to at least one area on the substrate during polishing, so that the monitor signal of the measurement point converges on the reference signal.

2. The polishing apparatus as recited in claim 1, wherein said controller is configured to independently control pressing forces applied to a plurality of areas on the substrate, said sensor is operable to monitor substrate conditions of a plurality of measurement points on the substrate.

3. The polishing apparatus as recited in claim 2, further comprising a top ring having a plurality of pressure chambers for independently applying pressing forces to the plurality of areas on the substrate.

4. The polishing apparatus as recited in claim 2, wherein said controller is operable to calculate an averaged value of monitor signals of the plurality of measurement points at the beginning of polishing, and translate the reference signal in parallel with respect to a time series so that a reference signal at the beginning of polishing is equal to the averaged value.

5. The polishing apparatus as recited in claim 2, wherein said controller is operable to calculate an averaged value of monitor signals of the plurality of measurement points at a desired time point of a polishing process, and translate the reference signal after the desired time point in parallel with respect to a time series so that a reference signal at the desired time point is equal to the averaged value.

6. The polishing apparatus as recited in claim 1, wherein said controller is operable to translate the reference signal in parallel with respect to a time series so that a reference signal at the beginning of polishing is equal to a monitor signal of a predetermined measurement point on the substrate at the beginning of polishing.

7. The polishing apparatus as recited in claim 1, wherein said controller is operable to translate the reference signal after a desired time point of a polishing process in parallel with respect to a time series so that a reference signal at the desired time point is equal to a monitor signal of a predetermined measurement point on the substrate at the desired time point.

8. The polishing apparatus as recited in claim 1, wherein said controller is operable to translate the reference signal in parallel with respect to a time series at the beginning of polishing so that a polishing time becomes a desired period of time.

9. The polishing apparatus as recited in claim 1, wherein said controller is operable to calculate a time point of the reference signal which is equal to the monitor signal, at a desired time point of a polishing process, and calculate a period of time from the time point at which the reference signal is equal to the monitor signal to a reference time point at which the reference signal becomes a predetermined value.

10. The polishing apparatus as recited in claim 1, wherein the reference signal is a signal in which at least one of a type of film formed on the substrate, a laminated structure, an interconnection structure, a physical property of a polishing liquid, a temperature of said polishing surface, a temperature of the substrate, and a thickness of a polishing tool forming said polishing surface is set as a parameter.

11. The polishing apparatus as recited in claim 1, wherein a monitor signal obtained during a past polishing process using a polishing surface used in a present polishing process, or a monitor signal obtained at an initial stage of a past polishing process using another polishing surface already replaced is used as the reference signal.

12. The polishing apparatus as recited in claim 1, wherein the controller is operable to control the pressing force by using a predictive control.

13. The polishing apparatus as recited in claim 12, wherein a control period of said controller is in a range of from 1 second to 10 seconds.

14. The polishing apparatus as recited in claim 1, wherein said monitor unit is operable to exclude a monitor signal of a measurement point at a peripheral edge portion of the substrate.

15. The polishing apparatus as recited in claim 1, wherein said monitor unit is operable to correct a monitor signal of a measurement point at a peripheral edge portion of the substrate.

16. The polishing apparatus as recited in claim 1, wherein said sensor comprises at least one of an eddy-current sensor, an optical sensor, and a microwave sensor.

17. The polishing apparatus as recited in claim 1, wherein said sensor is operable to measure a film thickness on a surface of the substrate.

18. The polishing apparatus as recited in claim 3, further comprising an actuator for providing a relative movement between said polishing table and said top ring, wherein said sensor is disposed within said polishing table.

19. The polishing apparatus as recited in claim 18, wherein said actuator comprises a motor for rotating said polishing table.

20. The polishing apparatus as recited in claim 1, wherein said controller is operable to interrupt the control intermittently during polishing.

21. The polishing apparatus as recited in claim 1, wherein said controller is operable to finish the control before a polishing endpoint and hold a polishing condition at that time until the polishing endpoint.

22. The polishing apparatus as recited in claim 1, wherein said controller is operable to employ a polishing condition at a time point at which polishing of one substrate is finished as an initial polishing condition for polishing of another substrate.

23. The polishing apparatus as recited in claim 1, wherein said controller is operable to detect a polishing endpoint based on a signal of said monitor unit.

24. A polishing apparatus comprising:

a polishing table for supporting a polishing surface;

a top ring for pressing a substrate against said polishing surface while independently controlling pressing forces applied to a plurality of areas on the substrate;

a sensor for monitoring substrate conditions of a plurality of measurement points on the substrate during polishing;

a monitor unit for performing a predetermined arithmetic process on a signal from said sensor to generate a monitor signal; and a controller for controlling the pressing forces applied to the plurality of areas on the substrate during polishing, said controller being configured to adjust the pressing forces within a predetermined range, when variations of the pressing forces are calculated and a pressing force to be applied to at least one of the areas exceeds the predetermined range, by scaling the variations so that a proportion of differences at respective areas between the pressing forces and a reference value, set for the pressing forces, is maintained after scaling or by scaling the variations so that the proportion of the variations at the respective areas is maintained after scaling.

25. A polishing apparatus comprising:

a polishing table for supporting a polishing surface;

a top ring for pressing a substrate against said polishing surface while independently controlling pressing forces applied to a plurality of areas on the substrate;

a sensor for monitoring substrate conditions of a plurality of measurement points on the substrate during polishing;

a monitor unit for performing a predetermined arithmetic process on a signal from said sensor to generate a monitor signal; and a controller for controlling the pressing forces applied to at least one area on the substrate during polishing, by fuzzy control or model predictive control, so that the monitor signal of the measurement points converges on a reference signal and a sensitivity of a manipulated value of the pressing forces applied to the plurality of areas during polishing can be adjusted.

26. A polishing method comprising:

monitoring a substrate condition of at least one measurement point on a substrate by a sensor during polishing;

performing a predetermined arithmetic process on a signal from the sensor to generate a monitor signal;

predicting a predicted value of the monitor signal;

comparing the predicted value of the monitor signal of the measurement point with a reference signal representing a relationship between a reference value for the monitor signal and time; and pressing the substrate against a polishing surface to polish the substrate while controlling a pressing force applied to at least one area on the substrate during polishing so that the monitor signal of the measurement point converges on the reference signal.

27. A processing method comprising:

monitoring a substrate condition of at least one measurement point on a substrate by a sensor during processing;

performing a predetermined arithmetic process on a signal from the sensor to generate a monitor signal;

predicting a predicted value of the monitor signal;

comparing the predicted value of the monitor signal of the measurement point with a reference signal representing a relationship between a reference value for the monitor signal and time; and forming a film on the substrate while controlling the substrate condition of the substrate so that the monitor signal of the measurement point converges on the reference signal.

* * * * *